US007762685B1

(12) United States Patent
Beucler

(10) Patent No.: US 7,762,685 B1
(45) Date of Patent: Jul. 27, 2010

(54) UNDER WATER LIGHTING SYSTEM

(76) Inventor: Paul V. Beucler, 13923 Berkowitz Ave., Hudson, FL (US) 34667

( * ) Notice: Subject to any disclaimer, the term of this patent is extended or adjusted under 35 U.S.C. 154(b) by 485 days.

(21) Appl. No.: 11/804,793

(22) Filed: May 21, 2007

Related U.S. Application Data

(63) Continuation-in-part of application No. 11/373,393, filed on Mar. 10, 2006.

(60) Provisional application No. 60/660,708, filed on Mar. 11, 2005.

(51) Int. Cl.
*F21V 29/00* (2006.01)

(52) U.S. Cl. ..... 362/267

(58) Field of Classification Search ..... 362/267
See application file for complete search history.

(56) References Cited

U.S. PATENT DOCUMENTS

| | | | | |
|---|---|---|---|---|
| 1,192,001 | A | 7/1916 | Ryan | |
| 1,745,901 | A | 2/1930 | McKay | |
| 3,005,908 | A | 10/1961 | Farina | |
| 3,502,861 | A | 3/1970 | Evans | |
| 3,946,263 | A | 3/1976 | Protzeller | |
| 4,429,350 | A | 1/1984 | Guthrie | |
| 4,500,151 | A | 2/1985 | Ayers | |
| 4,598,346 | A | 7/1986 | Bodde | |
| 4,869,683 | A | 9/1989 | Nelson | |
| 4,947,304 | A | 8/1990 | Payne et al. | |
| 5,607,224 | A | 3/1997 | Tobias et al. | |
| 5,651,209 | A * | 7/1997 | Rainey | 362/34 |
| 5,777,269 | A | 7/1998 | Handley | |
| 5,819,807 | A | 10/1998 | Reed | |
| 6,158,873 | A | 12/2000 | Griffiths | |
| 6,315,429 | B1 * | 11/2001 | Grandolfo | 362/267 |
| 6,491,407 | B1 | 12/2002 | Beadle | |
| 7,008,081 | B2 * | 3/2006 | Lunt | 362/267 |
| 2002/0178641 | A1 * | 12/2002 | Kent | 43/17.5 |

* cited by examiner

*Primary Examiner*—Sandra L O'Shea
*Assistant Examiner*—William J Carter
(74) *Attorney, Agent, or Firm*—Frijouf, Rust & Pyle, P.A.

(57) ABSTRACT

An improved lighting system is disclosed for location beneath a surface of a body of water for illuminating the water. The lighting system comprises a light bulb having a cap and a body having a positive buoyancy. An electrical conductor electrically couples the cap of the light bulb to an electrical source. An encasement encapsulates the cap of the light bulb. An elongated conduit sheaths the electrical conductor. An anchor engages the elongated conduit for submerging the light bulb beneath the surface of the water.

3 Claims, 13 Drawing Sheets

UNDER WATER LIGHTING SYSTEM

CROSS-REFERENCE TO RELATED APPLICATIONS

This is a continuation-in-part of U.S. patent application Ser. No. 11/373,393 filed Mar. 10, 2006. All subject matter set forth in application Ser. No. 11/373,393 is hereby incorporated by reference into the present application as if fully set forth herein.

This application claims benefit of U.S. Patent Provisional application Ser. No. 60/660,708 filed Mar. 11, 2005. All subject matter set forth in provisional application Ser. No. 60/660,708 is hereby incorporated by reference into the present application as if fully set forth herein.

BACKGROUND OF THE INVENTION

1. Field of the Invention

This invention relates to lighting systems and more particularly to an improved apparatus and method for illuminating water from beneath a surface of a body of water.

2. Background of the Invention

Various types of apparatuses have been proposed by the prior art for illuminating water from beneath a surface of a body of water. Providing a source of light beneath the surface of a body of water has been utilized for facilitating navigation of vessels, attracting marine life and ornamental reasons. These lighting systems are exposed to harsh environmental conditions including, corrosion, motion from current, marine life or human interaction, and water penetration. As such, under water lighting systems must be resistant to corrosion, able to withstand natural and unnatural forces as well as water penetration. The following U.S. Patents are examples of attempts of the prior art to solve these problems.

U.S. Pat. No. 1,192,001 to Ryan discloses a fishing apparatus including a shore anchoring means including a holder and a source of current, a lamp, a conductor connecting the lamp and the source of current, a tube disposed about the conductor for protecting the conductor from contact with water, the conductor and the tube being of sufficient rigidity to resist flexure under flow of current to hold the lamp in its position of adjustment in a stream from the shore line, a transparent protective casing carried by the conductor in proximity to the lamp and encompassing the lamp, a disk float having an opening therein, the float being slidably and frictionally mounted on the tube through the medium of the opening and held in adjusted position at a bend of flexure thereon, and the float holding the lamp at a desired depth in a stream and being prevented form having sliding movement on the tube by the bend of flexure when the casing is accidentally moved.

U.S. Pat. No. 1,745,901 to McKay discloses an underwater lighting unit comprising a bulb having a filament therein, a conductor for supplying electrical energy to the filament, connection between the conductor and the filament, an elastic sleeve surrounding the connection, a rigid casing surrounding the sleeve, the casing having apertures to permit water pressure against the elastic sleeve to hold the same in water-tight relation with the connection.

U.S. Pat. No. 3,502,861 to Evans discloses a post mounted vertically upon the stem of a boat by a U-shaped mounting member having a shorter leg connected to the post and longer leg positioned against the inner surface of the stern. A flexible cable extends from the lower end of the post and has a water-tight sealed light on its end to trail freely in the water.

U.S. Pat. No. 4,429,350 to Guthrie discloses A subsurface light comprising an illumination source and an elongate handle attached to and extending from the illumination source. The length of the handle is adjustable. The light further includes a buoyant body having generally planar inboard and outboard services connected to the handle inboard of the illumination source. At least one plate secured to the buoyant body is mounted to the handle by an integral flap.

U.S. Pat. No. 4,598,346 to Bodde discloses A submersible fishing light in which the electrical components are sealed within a water impervious plastic shell. Insulated electrical wires extend into the shell and connect with a socket which receives the base of an incandescent bulb. The base of the bulb is threaded through a lead weight which serves as ballast. The neck of the bulb is sealed to the shell by a compressible sponge ring. A metal wire has hook ends embedded in the lead weight and forms an eye through which the electrical wiring extends. In an alternative embodiment, a protective cage surrounds the bulb and is anchored in place by rods having hook ends embedded in the lead weight.

U.S. Pat. No. 4,947,304 to Payne, et al. discloses An underwater lighting apparatus includes a lamp having a filament, an envelope surrounding the filament, and a pair of contacts extending through the envelope, and a wiring arrangement for electrically connecting the contacts to a source of electrical power. The wiring arrangement includes a socket assembly on which the lamp is removably retained through a friction fit connection between the contacts of the lamp and a pair of terminals of the socket assembly and includes a transparent casing having an open axial end and a closure member retained in the open axial end. The closure member may be removed from the open axial end of the casing to permit replacement of the lamp in the socket assembly.

U.S. Pat. No. 5,777,269 to Handley discloses A cable (10) has a plurality of conductors (12) with individual conductive shields (14) and one common shield (16) for all conductors, the outer end portions of which shields are terminated by being clampingly retained between tapered surfaces (48,52; 50,54) of the first, second and third termination rings (42,44, 46).

U.S. Pat. No. 5,819,807 to Reed discloses Flexible convoluted conduit covered with braid made by cold forming the braid to an end of the conduit. Cold forming can involve magneforming. Resulting conduit is not brazed, welded, or annealed, thereby facilitating construction of convoluted conduits with higher working pressures and/or less braid material.

U.S. Pat. No. 6,315,429 to Grandolfo discloses A high intensity light is mounted and sealed in a polyvinyl chloride (PVC) receptacle and extension system. The receptacle is adapted to be anchored on the bottom of a channel or an underwater area adjacent to a structure which provides alternating current (AC) power from a shoreside mains. The high intensity lamp may be sealed within a transparent enclosure, but is preferably left exposed to minimize sealife growth on the lamp. The PVC receptacle is preferably weighted, such as for example with concrete, to help anchor the receptacle to the bottom. The receptacle further includes rebar extending from the receptacle to penetrate the hard pack below the silt on the bottom.

U.S. Pat. No. 7,008,081 to Lunt discloses an underwater light includes a high intensity lamp placed in an enclosure that allows for easy lamp replacement in case of breakage or natural failure. Electrical wires are soldered to a metal fitting on the lamp. The metal fitting is received in a plastic nipple and the space between the fitting and nipple is filled with a sealant, leaving the ends of the wires exposed. The wires are connected by water proof twist-on wire connectors and the end of the lamp is enclosed by a rubber boot and an end cap. When the lamp burns out, it is easily replaced by fishing the light out of the water, removing the rubber boot to expose the twist-on wire connectors. The twist-on wire connectors are removed and the old lamp discarded. A new lamp is installed in reverse order.

U.S. Patent Application 20020178641 to Kent discloses A device for attracting fish comprises an underwater electrically powered light with photoelectric means for activating the light at dusk and deactivating the light at dawn, and weighted to negative buoyancy, the light being connected to an external ballast box in which the lamp ballast, photoelectric switch, and ground fault circuit interrupter are contained and connected to ordinary household current.

Although the aforementioned prior art have contributed to the development of the art of providing a reliable under water lighting systems, none of these prior art patents have solved the needs of this art.

Therefore, it is an object of the present invention to provide an improved apparatus for illuminating water from beneath a surface of a body of water.

Another object of this invention is to provide an improved under water lighting system that is resistant to water penetration.

Another object of this invention is to provide an improved under water lighting system wherein the electric conductor and light bulb are resistant to corrosion and separation.

Another object of this invention is to provide an under water lighting system that will withstand motion from current, marine life or human interaction.

Another object of this invention is to provide an under water lighting system wherein the depth of the light bulb from the surface of the water may be altered.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved method and apparatus for illuminating water from beneath a surface of a body of water. The apparatus includes lighting system located beneath the surface of the body of water. The lighting system comprises a light bulb having a cap and a body having a positive buoyancy. An electrical conductor electrically couples the cap of the light bulb to an electrical source. An encasement encapsulates the cap of the light bulb. An elongated conduit sheaths the electrical conductor. An anchor engages the elongated conduit for submerging the light bulb beneath the surface of the water.

In a more specific embodiment of the invention, the light bulb includes a mercury vapor bulb and the encasement includes a curable polymeric material. The encasement encapsulates the cap of the light bulb and at least a portion of the body of the light bulb. The anchor comprises a mass including a sleeve for slidably engaging the elongated conduit. The mass has a mass clip and the encasement has a bulb clip. A lanyard extends from the bulb clip through the mass clip to the surface of the water for simultaneously sliding the elongated conduit relative to the sleeve and adjusting the depth of the bulb with the body of water. A rode extends from the mass clip to the surface of the water for lowering and raising the anchor. An electrical switch positioned between the electrical conductor and the electrical source for controlling electrical current to the light bulb. A ground fault interrupter positioned between the electrical conductor and said electrical source for terminating electrical current to the electrical conductor upon a fault.

In one embodiment of the invention, a strain conveyer secures the encasement to the elongated conduit for transferring a tensile force from the encasement to the elongated conduit. The strain conveyer comprises a conduit grip secured to the conduit, an encasement grip secured to the encasement and a flexible braided conduit securing the encasement to the elongated conduit. A base is secured to the encasement for receiving the encasement grip. A coupler is secured to the elongated conduit for receiving the conduit grip. The flexible braided conduit secures the encasement grip to the conduit grip for transferring a tensile force from the encasement to the elongated conduit.

In a second embodiment of the invention, a receptacle receives the cap of the light bulb and at least a portion of the body of the light bulb. The encasement secures the receptacle to the cap of the light bulb and at least a portion of the body of the light bulb. A conduit coupler secures the elongated conduit to the receptacle for permitting the electrical conductor to enter the receptacle from the elongated conduit.

The invention is also incorporated into the method of encapsulating a cap and a portion of a body of a light bulb and coupling a cured encasement to an elongated conduit for submerging the light bulb beneath a surface of a body of water. The first method comprises the steps of soldering a plurality of electrical conductors to the cap of the light bulb. A jacket is positioned about a base and the light bulb. The jacket is filled with curable polymeric material through a threaded aperture in the base to bond the base to the cap and the portion of the body of the light bulb. The encasement grip is threaded into the base and the conduit grip is threaded into the elongated conduit. The flexible braided conduit is positioned between the encasement grip and the conduit grip for transferring a tensile force from the light bulb to the elongated conduit.

The second method comprises the steps of threading an electrical conductor through the receptacle. A plurality of electrical conductors are soldered to the cap of the light bulb. The elongated conduit is secured to the receptacle. The cap and a portion of the body of the light bulb is positioned into the receptacle. A sealant is poured into the elongated conduit. The receptacle is filled with curable polymeric material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
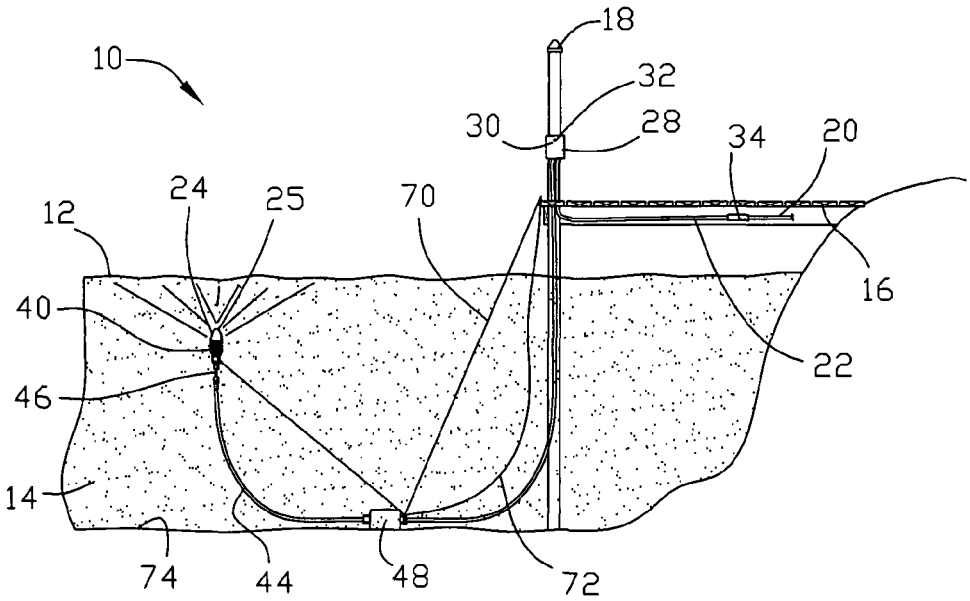
FIG. 1 is a side view of a lighting system located beneath a surface of a body of water incorporating the present invention.

FIG. 1 is side a view of a lighting system 10 located beneath a surface 12 of a body of water 14 for illuminating the water 14. The body of water 14 may be a fresh water lake or stream or salt water channel or ocean. The lighting system 10 as shown in FIG. 1 is installed adjacent a dock 16 that is supported by a piling 18. An electrical source 20 is provided for supplying electrical current to the lighting system 10. The electrical source 20 may be 110 Volts, AC (alternating current). Electrical current travels through an electrical conductor 22 from the electrical source 20 to a light bulb 24. The light bulb 24 may include a 175 watt Philips mercury vapor bulb 25. The electrical conductor 22 may include Colman cable (E54864-H SEOPRENE 105 16 AWG 3/C SEOOW (UL) 600V −50 TO 105c CSA LL39753-H FT2 WATER-RESISTANT((0.29/FT))). The lighting system further includes a center-tapped step-up transformer 26 (not shown) that develops the needed AC voltage for the light bulb 24. This step-up transformer 26 may include a (175W H39 mercury lamp MV-175 Ballast Class 180(H)). The transformer 26 is positioned within a housing 28 that is secured to the piling 18. The housing 28 is preferably a water proof enclosure and may include a Stahlin Non-Metallic Enclosure, (JH806HW, code A UPC# 21073). The lighting system 10 also includes a switch 30 placed between the electrical conductor 22 and the electrical source 20 for controlling electrical current to the light bulb 24. The switch 30 may include photoelectric switch 32 for automatically turning on light bulb 24 at dusk and turning off the light bulb 24 at dawn. The lighting system 10 includes a ground fault interrupter 34 placed between the electrical conductor 22 and the electrical source 20 for terminating electrical current to the electrical conductor 22 upon a fault. The ground fault interrupter 34 may include a Leviton industrial grade automatic reset (FGI Cord 15 Amp, 125 Volt, NEMA 5-15).

Figure 2:
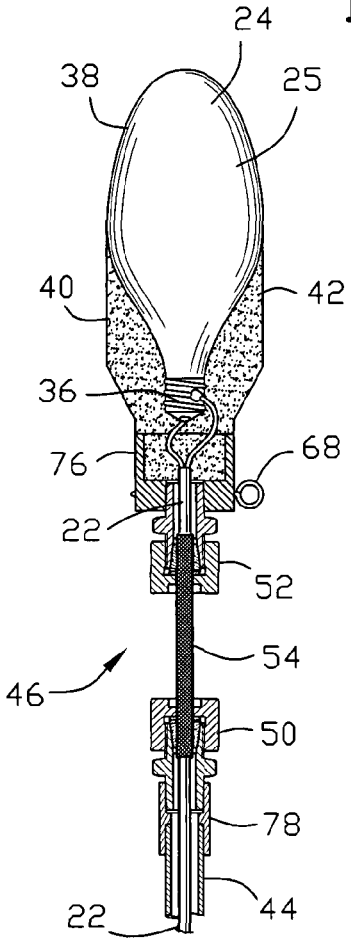
FIG. 2 is a sectional and magnified view of an upper portion of FIG. 1.
Figure 3:
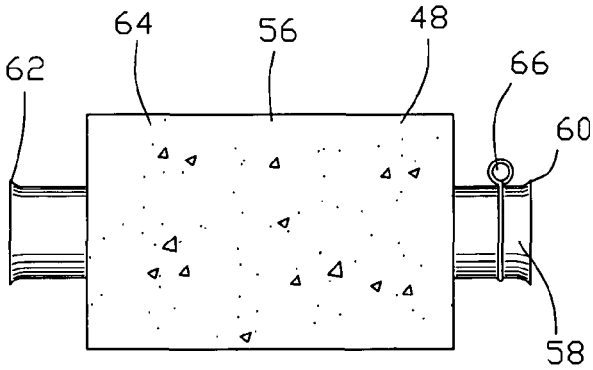
FIG. 3 is a magnified view of a lower portion of FIG. 1.

FIGS. 1-3 are various views of the lighting system 10 for illuminating the water 14 incorporating the present invention. The light bulb 24 includes a cap 36 and a body 38 having a positive buoyancy. The body 38 of the light bulb 24 does not contain a protective shield or reflectors. By placing the water 14 in direct contact with to the body 38 of the light bulb 24, the intensity of the illumination given off by the light bulb 24 reduce any growth build up on the light bulb 24. The electrical conductor 22 electrically couples the cap 36 of the light bulb 24 to the electrical source 20. An encasement 40 for encapsulates the cap 36 of the light bulb 24. The encasement 40 may comprises a curable polymeric material 42. The curable polymeric material 42 may include an electrical encapsulating and casting epoxy (EpoxySystems product #1700). An elongated conduit 44 travels from the housing 28 to within four (4) to twelve (12) inches of the light bulb 24. The elongated conduit 44 sheaths the electrical conductor 22. The elongated conduit 44 may include nonmetallic tubing manufactured by Carlton Lamson and Sessions under flex-plus blue, (E73317). The elongated conduit 44 is flexible but ridge enough to prevent the elongated conduit 44 from kinking. A strain conveyer 46 secures the encasement 40 to the elongated conduit 44 for transferring a tensile force from the encasement 40 to the elongated conduit 44. An anchor 48 engages the elongated conduit 44 for submerging the light bulb 24 beneath the surface 12 of the water 14. The strain conveyer 46 comprises a conduit grip 50 secured to the elongated conduit 44, an encasement grip 52 secured to the encasement 40 and a flexible braided conduit 54 securing the encasement 40 to the elongated conduit 44.

The anchor 48 further comprises a mass 56 wherein the mass 56 contains a sleeve 58 for slidably engaging the elongated conduit 44. The sleeve 58 preferably includes a two and one-half (2½) inch PVC pipe with a first and second flared ends 60 and 62 to reduce chaffing of the elongated conduit 44. The mass 56 may be constructed from concrete 64 and preferably having a weight of thirteen (13) pounds. The weight of the mass 56 may be altered depending upon depth and tidal conditions of the water 14. The mass further includes a mass clip 66. The encasement 40 similarly includes a bulb clip 68. A lanyard 70 extends from the bulb clip 68 through the mass clip 66 and to the surface 12 of the water 14 for adjusting the depth of the bulb 24 with the body of water 14. Since the elongated conduit 44 ridge enough to prevent the elongated conduit 44 from kinking, by utilizing the lanyard 70 the elongated conduit 44 may be slide relative to the sleeve 58 and simultaneously adjusting the depth of the bulb 24 with the body of water 14. A rode 72 extends form the mass clip 66 to the surface 12 of the water 14 for lowering and raising the anchor 48.

Figure 4:
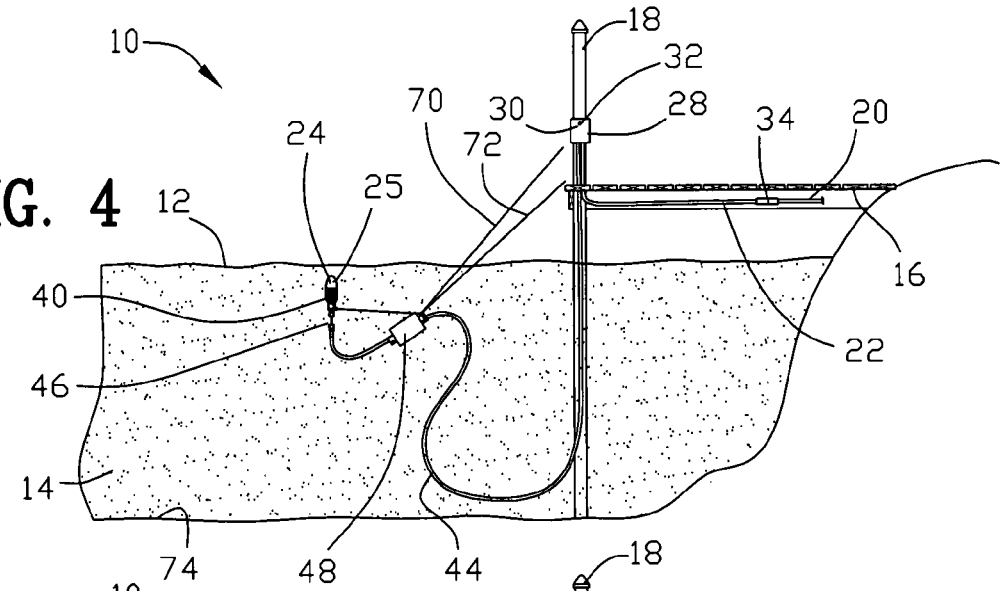
FIG. 4 is a side view similar to FIG. 1 illustrating the lighting system being lowered beneath the surface of the body of water.
Figure 5:
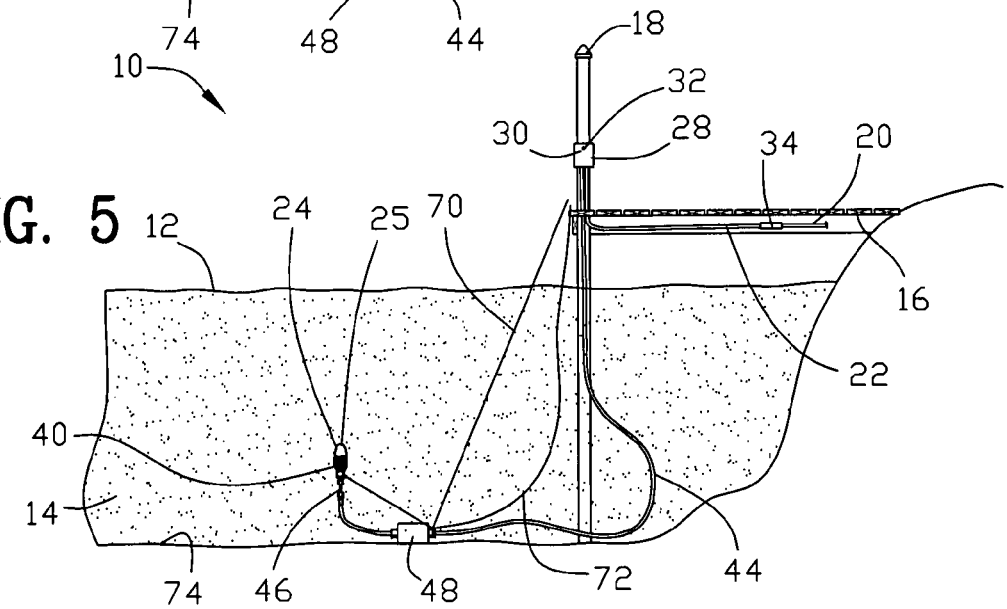
FIG. 5 is a side view similar to FIG. 16 illustrating the lighting system resting on the water bed with the light bulb in proximity to an anchor.
Figure 6:
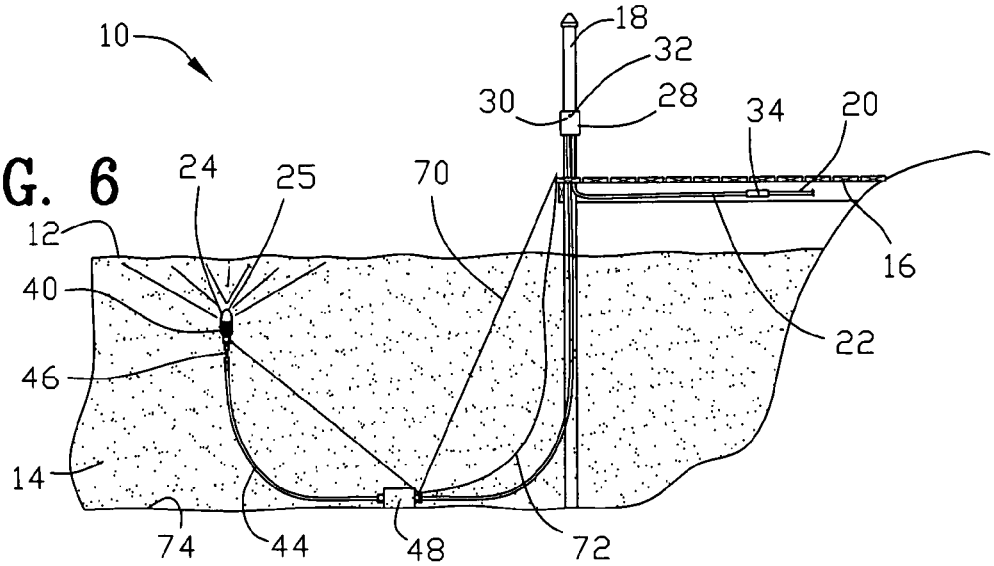
FIG. 6 is a side view similar to FIG. 17 with the light bulb distanced from the anchor.

FIGS. 4-6 are side views similar to FIG. 1 illustrating the positioning of the lighting system 10 adjacent the dock 22 and beneath a surface 12 of a body of water 14 for illuminating the water 14. The anchor 48 is lowered beneath the surface 12 of the water 14 by releasing the rode 72. As the anchor 48 is lowered, the light bulb 24 is kept in close proximity to the anchor 48 by releasing the lanyard 70 at the same rate as the rode 72. Once of the anchor 48 rests on the water bed 74, the elongated conduit 44 lies along the water bed 74 with the light bulb 24 in close proximity to the anchor 48. As the lanyard 70 is released, the positive buoyancy provided by the body 38 of the light bulb 24 causes the light bulb 24 to rise towards the surface 12 of the water 14 and simultaneously pulls the elongated conduit 44 through the sleeve 58. Alternatively, if the lanyard 70 is pulled in an upward direction, the light bulb 24 is forced away from the surface 12 of the water 14 and simultaneously forces the elongated conduit 44 back into the sleeve 58. The lanyard 70 permits a user to bring the light bulb 24 to the surface 12 of the water 14 for cleaning if necessary. In addition, the lanyard 70 permits varying depths of the light bulb 24 to provide the optimum illumination since the depth of water 14 may vary due to the tides and/or location. Preferably, the light bulb 24 should be positioned six (6) feet from the surface 12 of the water 14. If the water qualities is poor the light bulb 24 may require positioning at a lower depth. Also the lanyard 70 allows the light bulb 24 to be lowered towards the water bed 74 for vessels to pass over. Once the proper depth of the light bulb 24 is established, the lanyard maybe tied off one a cleat located on the dock 16. The lanyard 70 may include one-eighth (⅛) inch stuff rope.

In a more specific embodiment of the invention, the encasement 40 encapsulates the cap 36 of the light bulb 24 and at least a portion of the body 38 of the light bulb 24. The encasement 40 may encapsulate one (1) to four (4) inches of the body 38. A base 76 is secured to the encasement 40 for receiving the encasement grip 52. A coupler 78 is secured to the elongated conduit 44 for receiving the conduit grip 50.

Figure 7:
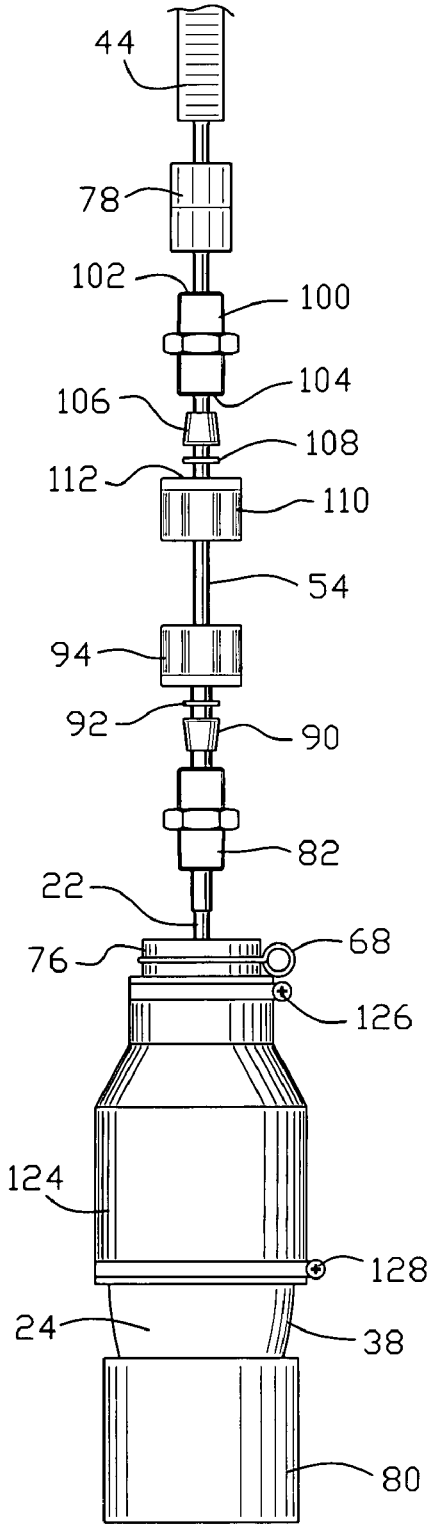
FIG. 7 is an inverted view of FIG. 2 illustrating a jacket and an exploded view of a strain conveyer with a light bulb resting on a stand.
Figure 8:
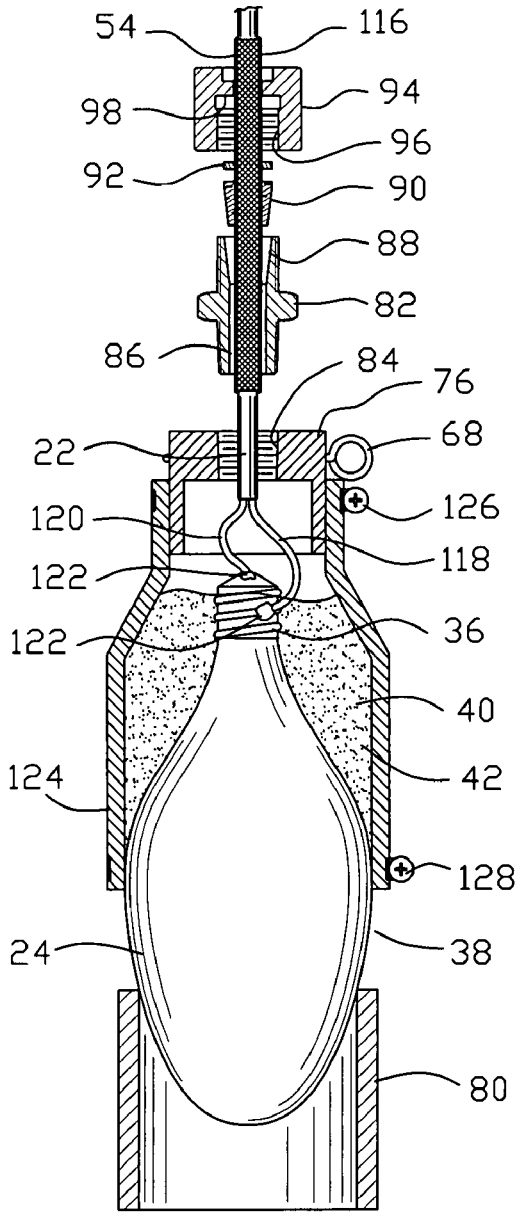
FIG. 8 is a magnified sectional view of a portion of FIG. 7.

FIG. 7 is an exploded view of the strain conveyer 46 with a light bulb 24 resting on a stand 80. FIG. 8 is a magnified sectional view of a portion of FIG. 4. The encasement grip 52 comprises a first threaded neck 82 for engaging a threaded aperture 84 within the base 76. The first threaded neck 82 may include a one-half (½) inch NPT male threading. The base 76 may include a two (2) inch strait with a one-half (½) inch NPT female threading. The first threaded neck 82 has a first channel 86 for permitting the electrical conductor 22 to traverse through the first threaded neck 82. The first threaded neck 82 also includes a first packing channel 88 for receiving a first packing gland 90. A first gasket 92 is positioned between the first packing gland 90 and a first compressive nut 94. The first compressive nut 94 has a threaded aperture 96 for threadably engaging the first threaded neck 82. The first compressive nut 94 also has a first packing surface 98 for engaging the first gasket 92.

Similarly, the conduit grip 50 comprises a second threaded neck 100 for engaging the coupler 78. The second threaded neck 100 may include a one-half (½) inch NPT male threading. The coupler 78 in turn threadably engages the elongated conduit 44. The coupler 78 may include a one-half (½) inch PVC slip coupling with a one-half (½) inch NPT female threading. The second threaded neck 100 has a second channel 102 for permitting the electrical conductor 22 to traverse through the second threaded neck 100. The second threaded neck 100 also includes a second packing channel 104 for receiving a second packing gland 106. A second gasket 108 is positioned between the second packing gland 106 and a second compressive nut 110. The second compressive nut 110 has a threaded aperture 112 for threadably engaging the second threaded neck 100. The second compressive nut 100 also has a second packing surface 114 (not shown) for engaging the second gasket 108. Both the conduit grip 50 and the encasement grip 52 may include a strain relief (Max-Loc Cord Sealing Grips).

FIGS. 8-14 illustrate the process for encapsulating the cap 36 and a portion of the body 38 of the light bulb 24 and coupling the cured encasement 40 to the elongated conduit 44 for submerging the light bulb 24 beneath the surface 12 of the body of water 14. The electrical conductor 22 is feed through the conduit grip 50 and encasement grip 52. The electrical conductor 22 is also feed through the flexible braided conduit 54 and a shrink wrap conduit 116 that covers the flexible braided conduit 54. The shrink wrap conduit 116 may be utilized to protect the mesh from growth build up. The light bulb 24 is positioned upon the stand 80 to retain the light bulb 24 in a vertical position. A first and second lead 118 and 120 of the electrical conductor 22 are secured directly to the cap 36 of the light bulb 24 by solder 122. A jacket 124 is positioned about the base 76 and the light bulb 24 using a first and second camp 126 and 128. The curable polymeric material 42 while in a liquid form is poured through the threaded aperture 84 in the base 76 until the jacket is filled. Once the polymeric material 42 has cured the resulting encasement 40 has bond the base 76 to the cap 36 and the portion of the body 38 of the light bulb 24. This encasement 40 prevents any water intrusion into the encasement 40 to prevent corrosion of the cap 36 and electrical conductor 22.

Figure 9:
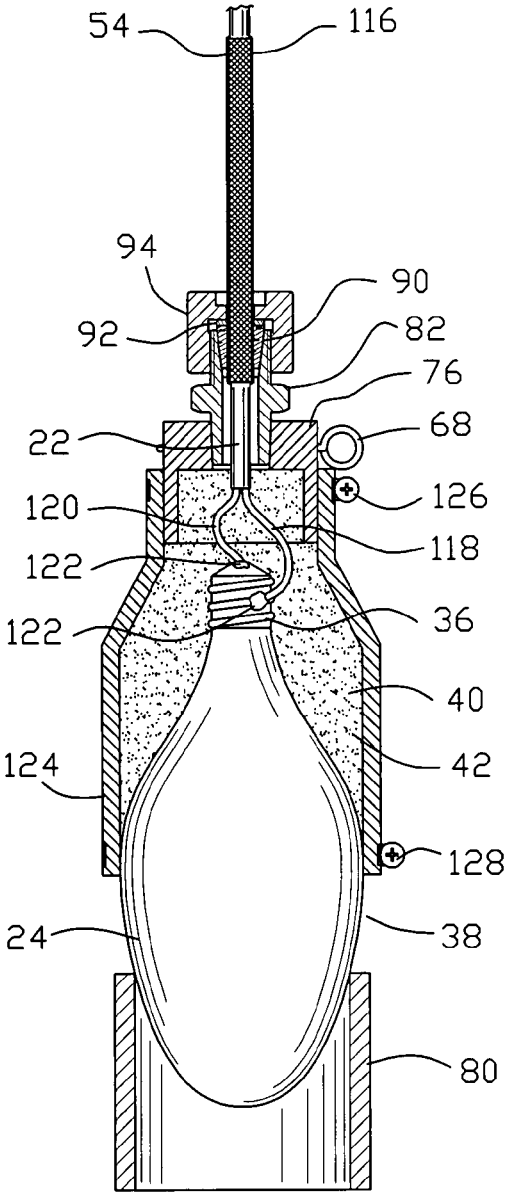
FIG. 9 is a sectional view similar to FIG. 8 illustrating an encasement grip engaging a base and a flexible braided conduit.
Figure 10:
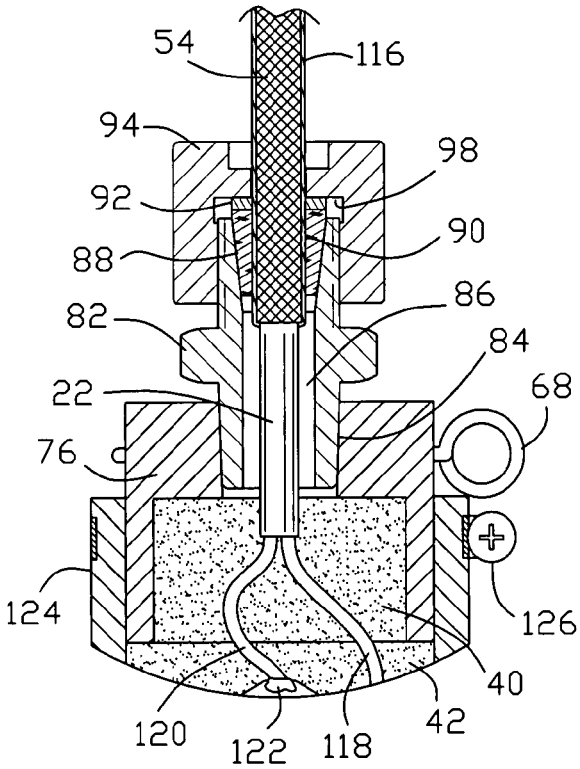
FIG. 10 is a magnified sectional view of a portion of FIG. 9.

FIGS. 9 and 10 illustrate the encasement grip 52 threadably engaging the base 76. The first threaded neck 82 is first threaded into the aperture 84 of the base 76. The first compressive nut 94 is then threadably engaged with the first threaded neck 82 for compressing the first packing surface 98 into the first gasket 92. The first gasket 92 in turn compresses the first packing gland 90 into the first packing channel 88. As the first compressive nut 94 increases the compressive force, the first packing gland 90 expands and grips both the flexible braided conduit 54 and a shrink wrap conduit 116 to lock the flexible braided conduit 54 relative to the encasement grip 52.

Figure 11:
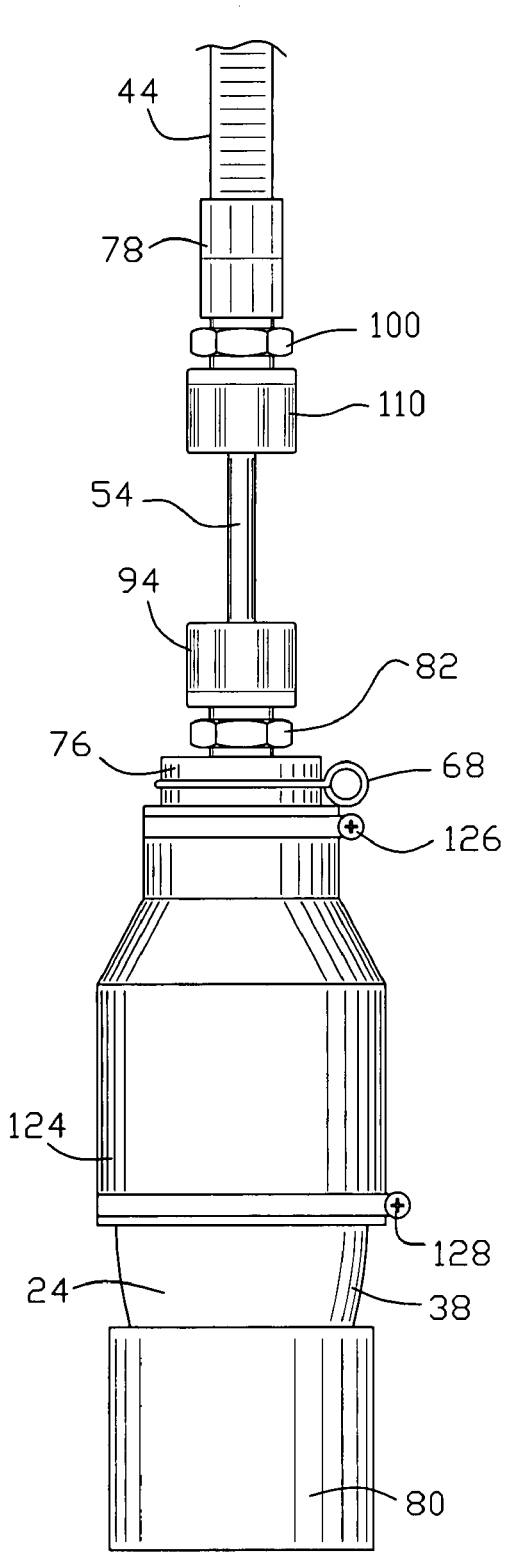
FIG. 11 is a side view similar to FIG. 7 with strain conveyer assembled.
Figure 12:
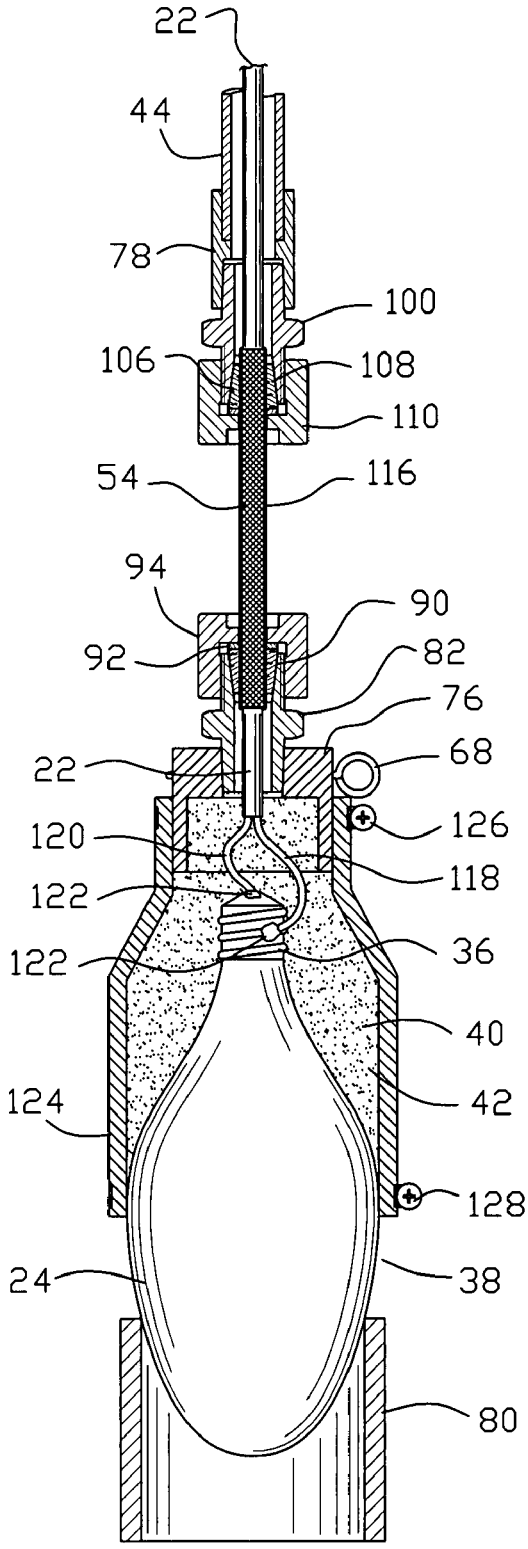
FIG. 12 is a sectional view of FIG. 11.

FIGS. 11 and 12 illustrate the conduit grip 50 threadably engaging the elongated conduit 44. The conduit grip 50 similarly has a second packing gland 104 which expands and grips both the flexible braided conduit 54 and a shrink wrap conduit 116 to lock the flexible braided conduit 54 relative to the conduit grip 50. With the flexible braided conduit 54 positioned between the encasement grip 52 and the conduit grip 50 the tensile force developed by the positive buoyancy of the body 38 of the light bulb 24 is transferred from the light bulb 24 to the elongated conduit 44.

Figure 13:
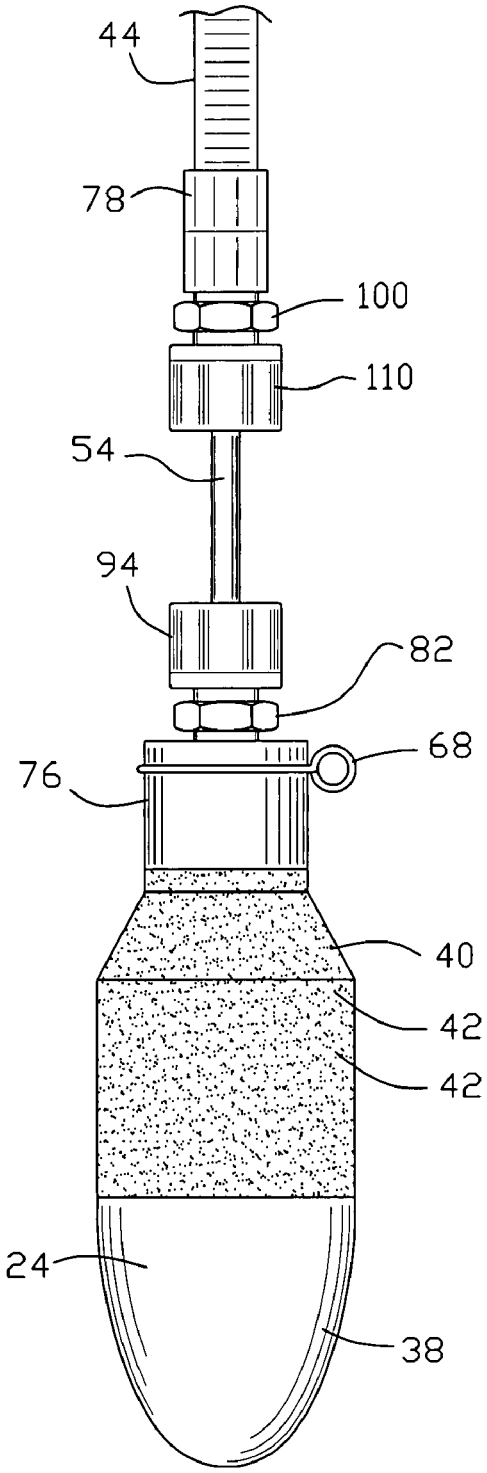
FIG. 13 is side view similar to FIG. 11 with the jacket and stand omitted.
Figure 14:
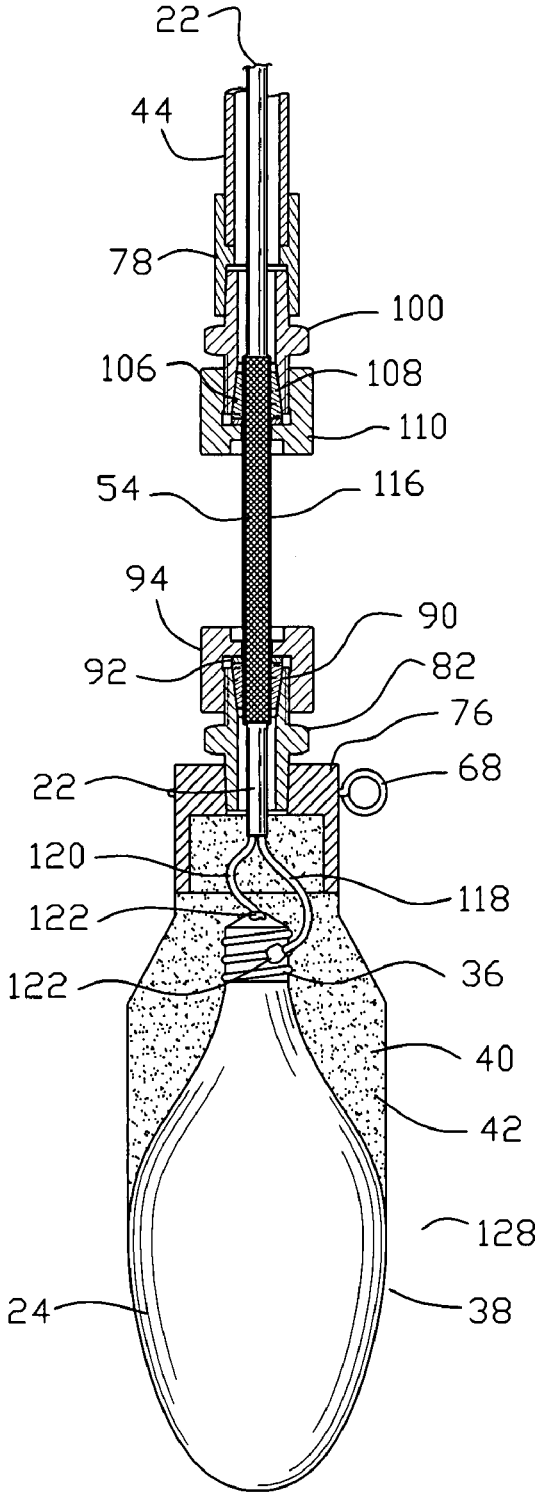
FIG. 14 is a sectional view of FIG. 13.
Figure 15:
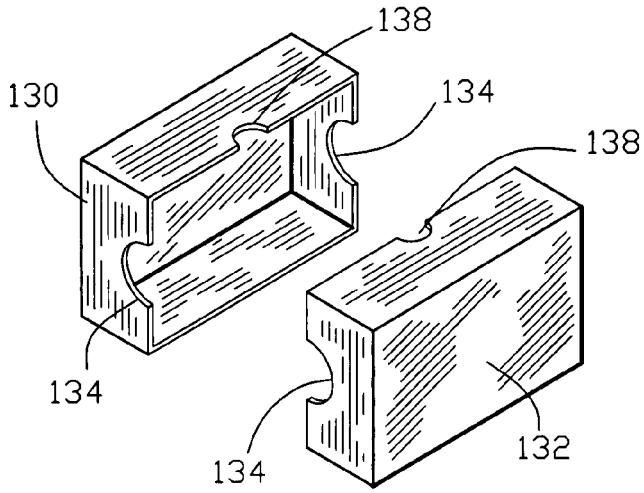
FIG. 15 is an isometric view of a first and a second form.
Figure 16:
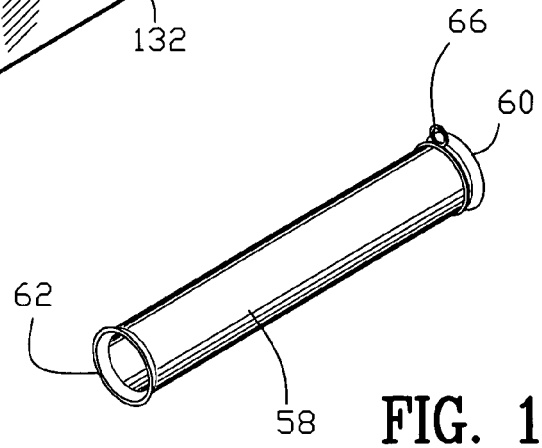
FIG. 16 is an isometric view of a sleeve.
Figure 17:
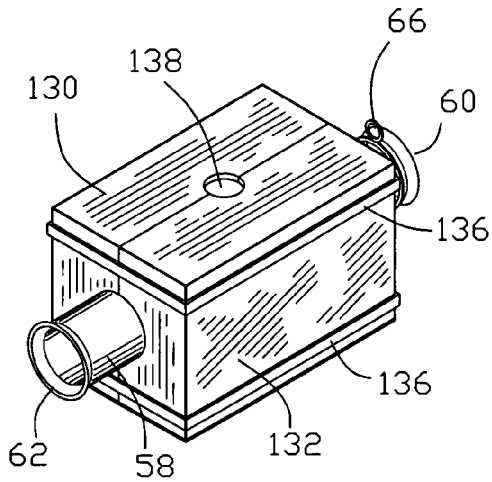
FIG. 17 is an isometric view of the first and second forms mated together with the sleeve traversing through and between the first and second forms.
Figure 18:
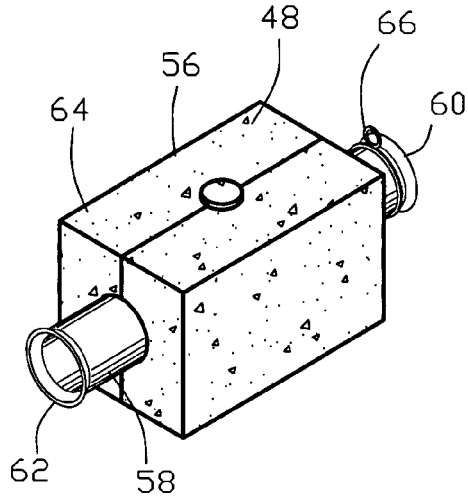
FIG. 18 is an isometric view of FIG. 3.

FIGS. 13 and 14 illustrate the removal of the jacket 124 from the base 76 and the light bulb 24 to expose the encasement 40. As an added measure the strain conveyer may include a layer of sirran wrap followed by a coating of anti-fouling material to further repeal moisture and prevent corrosion.

FIGS. 15-18 illustrate the process for encapsulating the sleeve 58 within the mass 56. A first and second form 130 and 132 have aligning arches 134. When the first and second forms 130 and 132 are secured together by retainers 136, the aligning arches 134 have the same shape as the sleeve 58. The first and second forms 130 and 132 also include a top arch 138 for introducing liquid concrete into the first and second forms 130 and 132. Once the concrete has cured, the first and second forms 130 and 132 are removed to expose the mass 56 with the sleeve 58 encapsulated with the concrete 64.

Figure 19:
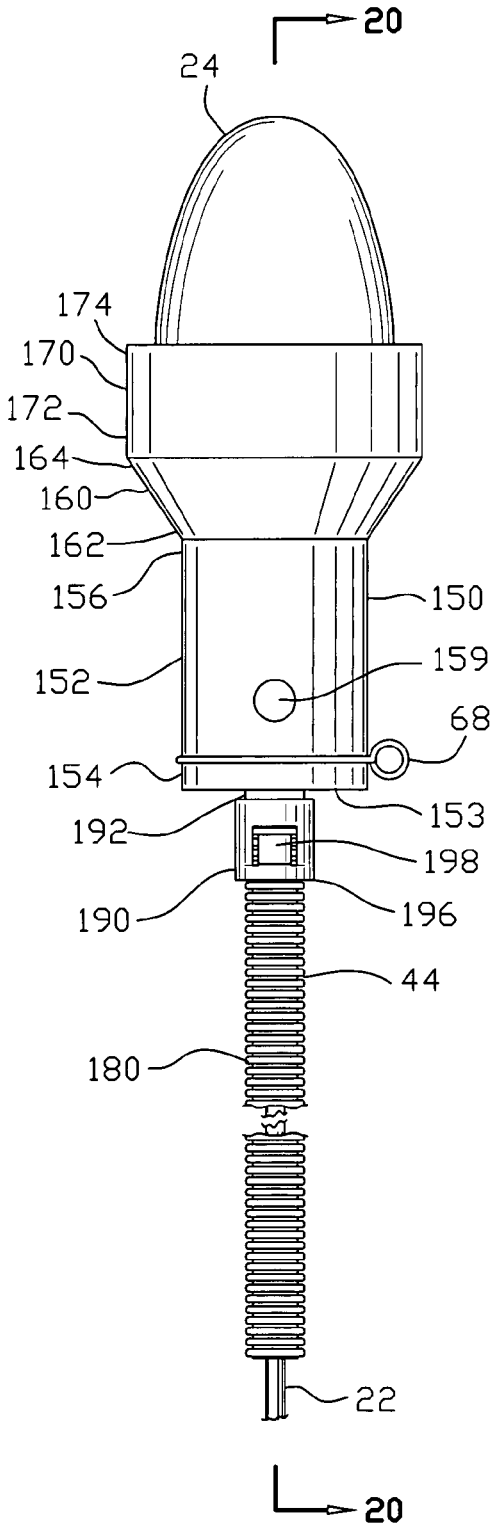
FIG. 19 is a side elevational view of a second embodiment of the present invention.
Figure 20:
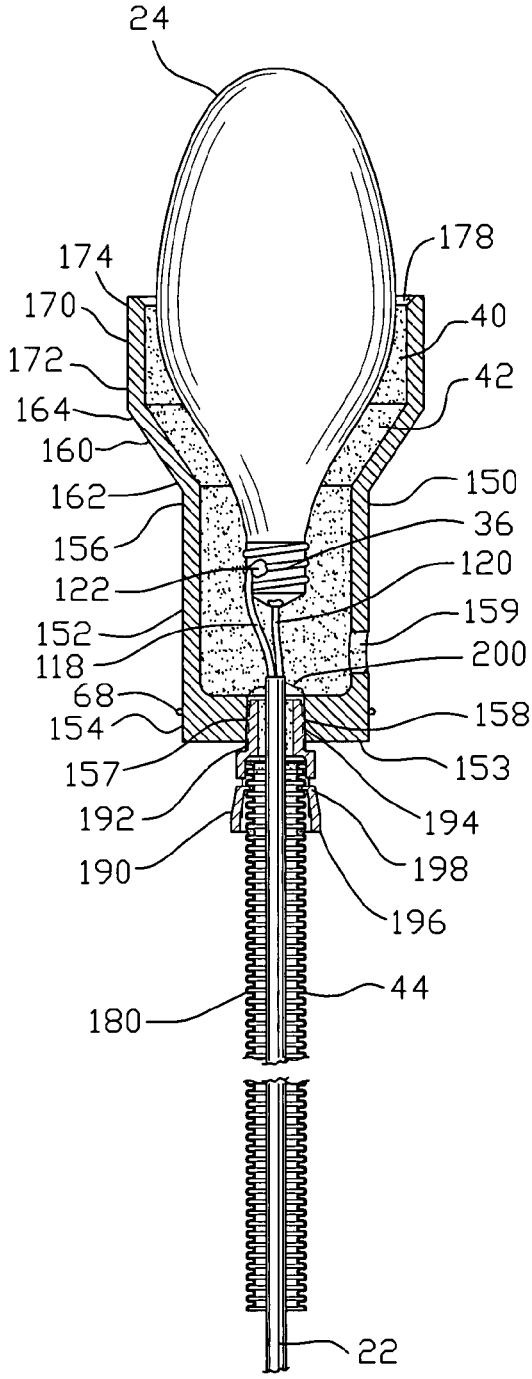
FIG. 20 is a sectional view along line 20-20 in FIG. 19.

FIGS. 19 & 20 illustrate a second embodiment of the subject invention. A receptacle 150 receives the cap 36 of the light bulb 24 and at least a portion of the body 38 of the light bulb 24. The receptacle 150 may encapsulate one (1) to four (4) inches of the body 38. The receptacle 150 includes a primary cylinder 152 having a first end 154 and a second end 156, a taper cylinder 160 having a first end 162 and a second end 164, and a secondary cylinder 170 having a first end 172 and a second end 174. The primary cylinder 152 and taper cylinder 160 may be formed from a single PVC fitting or other polymeric material. The secondary cylinder 170 may also be formed from a single PVC fitting or other polymeric material and fitted to the primary and taper cylinder 160 by adhesive. The primary cylinder 152, taper cylinder 160 and secondary cylinder 170 may also be formed from a single polymeric material or other material and be formed by injection molding.

The first end 154 of the primary cylinder 152 includes a cylinder base 153. The cylinder base 153 may be formed from a single PVC fitting or other polymeric material and fitted to the primary cylinder 152 by adhesive. The primary cylinder 152 and cylinder base 153 may also be formed from a single polymeric material or other material and be formed by injection molding. The cylinder base 153 includes a base aperture 157. The base aperture 157 may include aperture threads 158. The aperture threads 158 may include one-half (½) inch NPT female threading. A cylinder aperture 159 may be located within the primary cylinder 152 to inserting material from the exterior of the primary cylinder 152 into the base aperture 157. The cylinder aperture 159 may have a diameter between three-eighth of an inch (⅜") to one-half of an inch (½").

The second end 174 of the secondary cylinder 170 forms a receptacle aperture 176 for receiving the light bulb 24 into the receptacle 150. The inside diameter of the receptacle aperture 176 may include three and one-half inches (3½"). An aperture taper 178 may be located within the second end 174 of the secondary cylinder 170.

The elongated conduit 44 sheaths the electrical conductor 22. The elongated conduit 44 may include nonmetallic tubing manufactured by Carlton Lamson and Sessions under flex-plus blue, (E73317). The elongated conduit 44 is flexible but ridge enough to prevent the elongated conduit 44 from kinking. A plurality of ribs 180 are located on the elongated conduit 44.

The elongated conduit 44 is secured to the cylinder base 153 of the receptacle 150 by a conduit coupler 190. The conduit coupler 190 may include nonmetallic coupling manufactured by Carlton Lamson. The conduit coupler 190 includes a male coupler head 192 for engaging the base aperture 157 of the cylinder base 153. The coupler head 192 may include a threaded surface 194 for threadably engaging the aperture threads 158 for securing the receptacle 150 to the conduit coupler 190. The conduit coupler 190 also includes a female coupler head 196 for engaging the elongated conduit 44. The female coupler head 196 includes a rib lock 198 for engaging and locking the conduit coupler 190 to the elongated conduit 44.

FIGS. 21-24 illustrate the process for encapsulating the cap 36 and a portion of the body 38 of the light bulb 24 in the receptacle 150 and coupling the receptacle 150 to the elongated conduit 44 for submerging the light bulb 24 beneath a surface 12 of a body of water 14. The light bulb may first be covered with anti-fouling material to prevent organic growth on the light bulb. The anti-fouling may include Methyl Ethyl Ketone (MEK) or other anti-fouling material.

Figure 21:
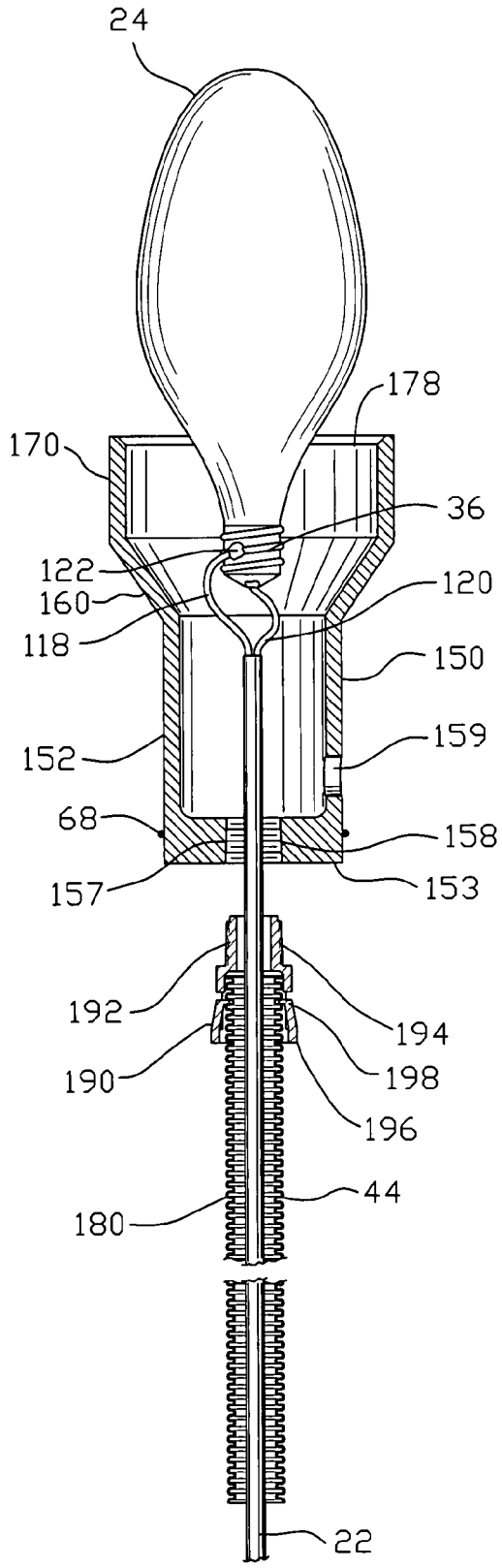
FIG. 21 is a sectional view similar to FIG. 20 illustrating the light bulb and a elongated conduit spaced from removed from a receptacle.

FIG. 21 illustrates the receptacle 150 being positioned between the light bulb 24 and the elongated conduit 44. The conduit coupler 190 is locked on the elongated conduit 44 by the rib lock 198. The electrical conductor 22 enters the receptacle 150 through the base aperture 157 and exits the receptacle 150 through the receptacle aperture 176. Both the first lead 118 and the second lead 120 are soldered to the cap 36 of the light bulb 24 for transferring voltage from the electrical source 20 to the light bulb 24.

Figure 22:
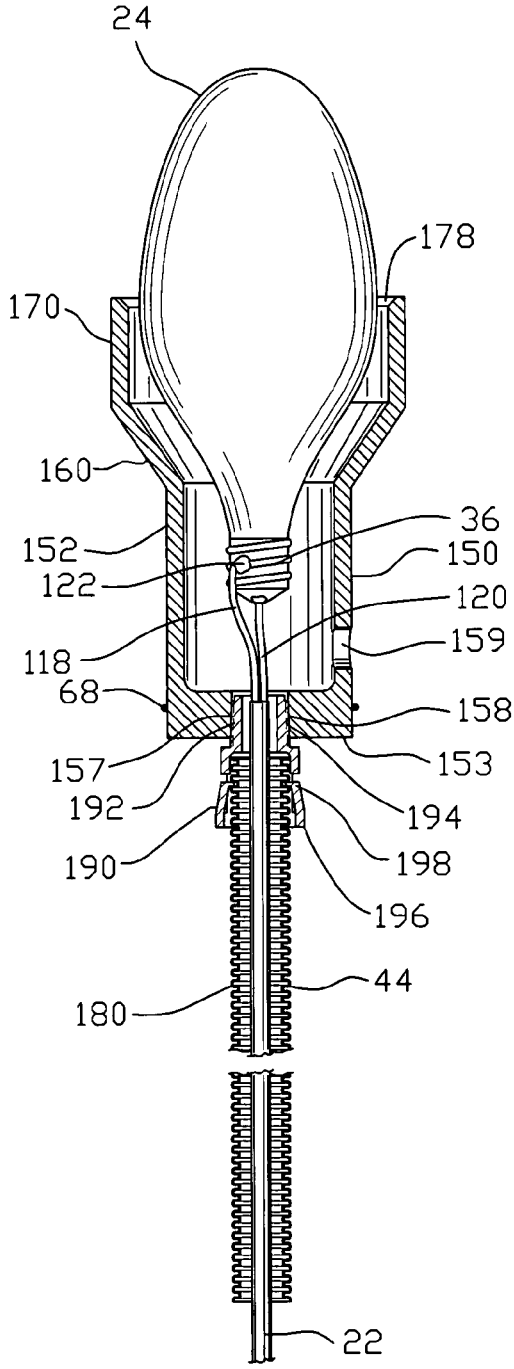
FIG. 22 is a sectional view similar to FIG. 21 illustrating the light bulb and a elongated conduit inserted into the receptacle.

FIG. 22 illustrates both the light bulb 24 and the elongated conduit 44 engaging the receptacle 150. The threaded surface 194 of the coupler head 192 threadably engages the aperture threads 158 of the base aperture 157 to secure the conduit coupler 190 to the receptacle 150. includes a male coupler head 192 for engaging the base aperture 157 of the cylinder base 153. The coupler head 192 may include a threaded surface 194 for threadably engaging the aperture threads 158 for securing the receptacle 150 to the conduit coupler 190. Thereafter, the cap 36 and a portion of the body 38 of the light bulb 38 are inserted through the receptacle aperture 176 and into the receptacle 150. As the light bulb 24 is inserted into the receptacle 150 the electrical conductor 22 is pulled back through the conduit coupler 190 and into the elongated conduit 44 so that the electrical conductor 22 travels vertically from the cap 36 to the conduit coupler 190. A gap may be present between the light bulb 24 and the edge of the receptacle aperture 176.

Figure 23:
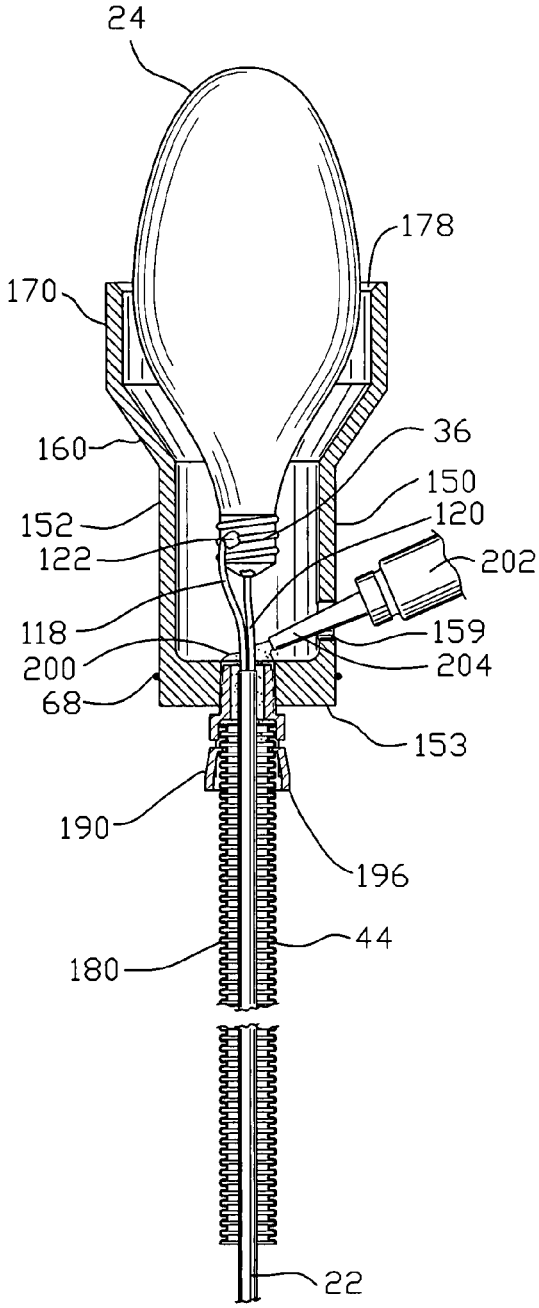
FIG. 23 is a sectional view similar to FIG. 22 illustrating a sealant poured into the elongated conduit.

FIG. 23 illustrates a sealant 200 being poured into the elongated conduit 44. The sealant 200 may be poured from a first dispenser 202 having a first dispenser nozzle 204. The nozzle 204 is inserted into the cylinder aperture 159 of the primary cylinder 152 for positioning over the conduit coupler 190. The sealant 200 exits the dispenser nozzle 204 and enters the conduit coupler 190. The sealant 200 is added until the sealant 200 fills the male coupler head 192 and begins entering the elongated conduit 44. The sealant 200 is to seal the area between electrical conductor 22 and the male coupler head 192 for preventing moisture from entering the receptacle 150. The sealant 200 may include 3-M 5200 sealant or other sealant materials.

Figure 24:
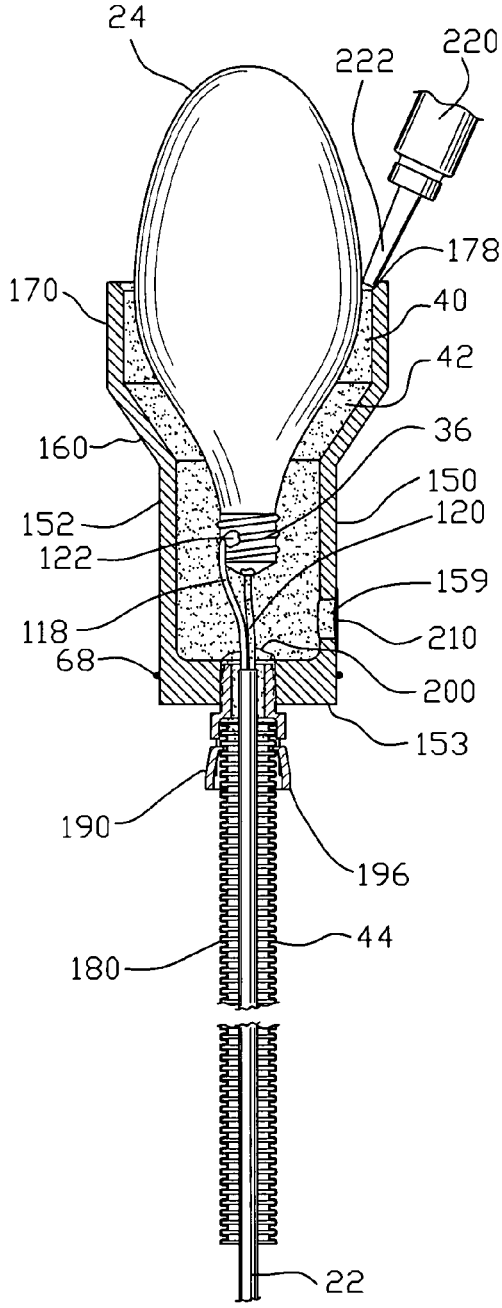
FIG. 24 is a sectional view similar to FIG. 23 illustrating a curable polymeric material filling the receptacle.
Figure 25:
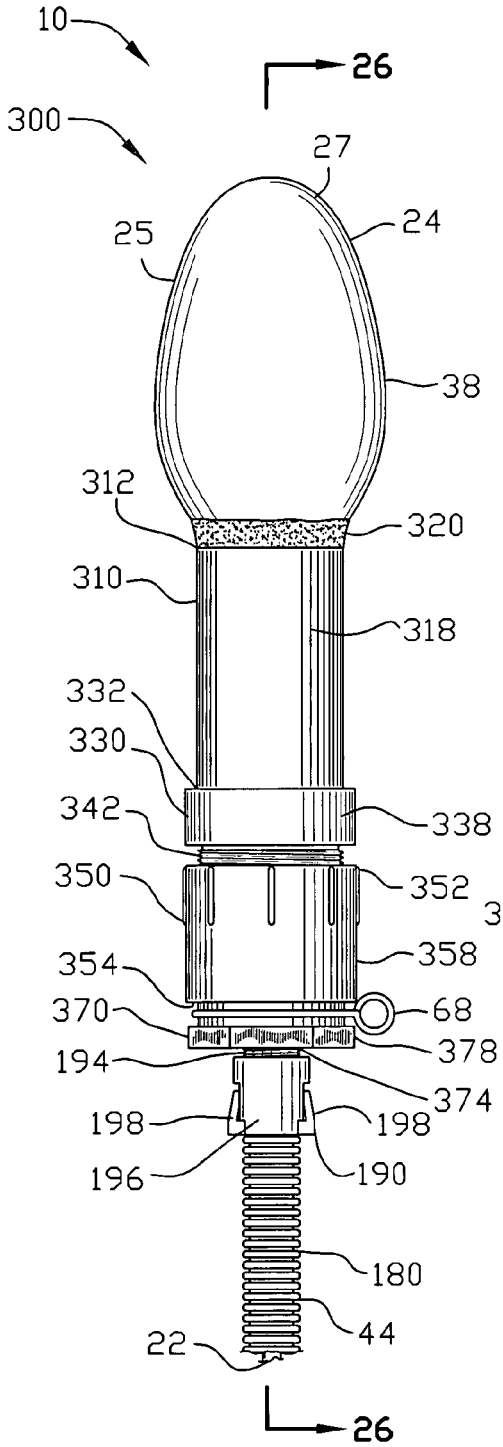
FIG. 25 is a side elevational view of a third embodiment of the present invention.
Figure 26:
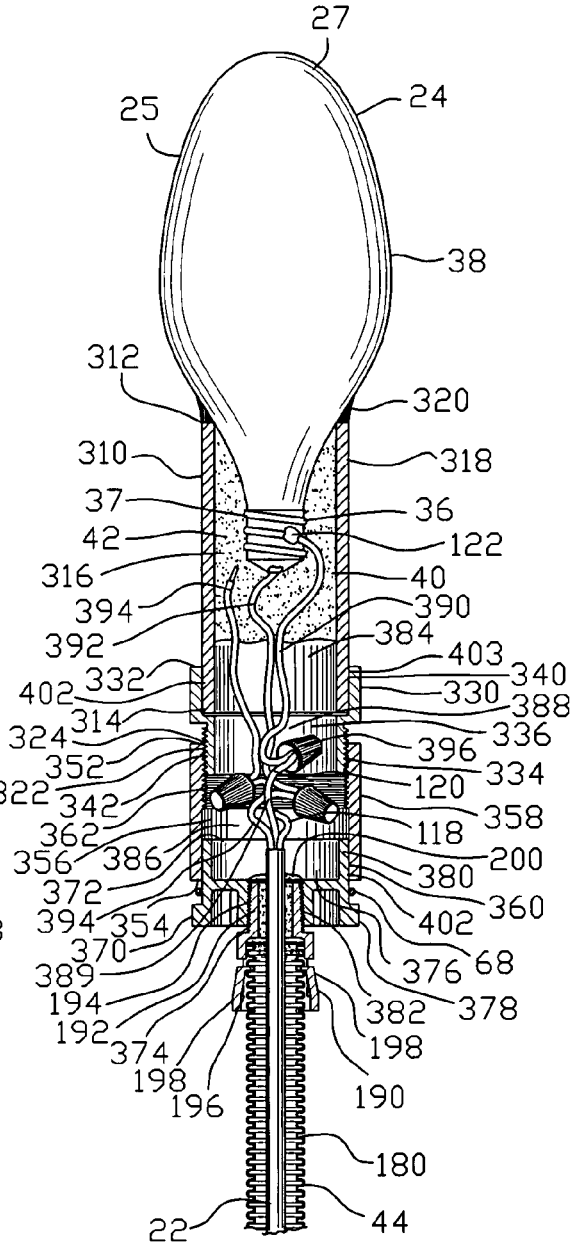
FIG. 26 is a sectional view along line 26-26 in FIG. 25.
Figure 27:
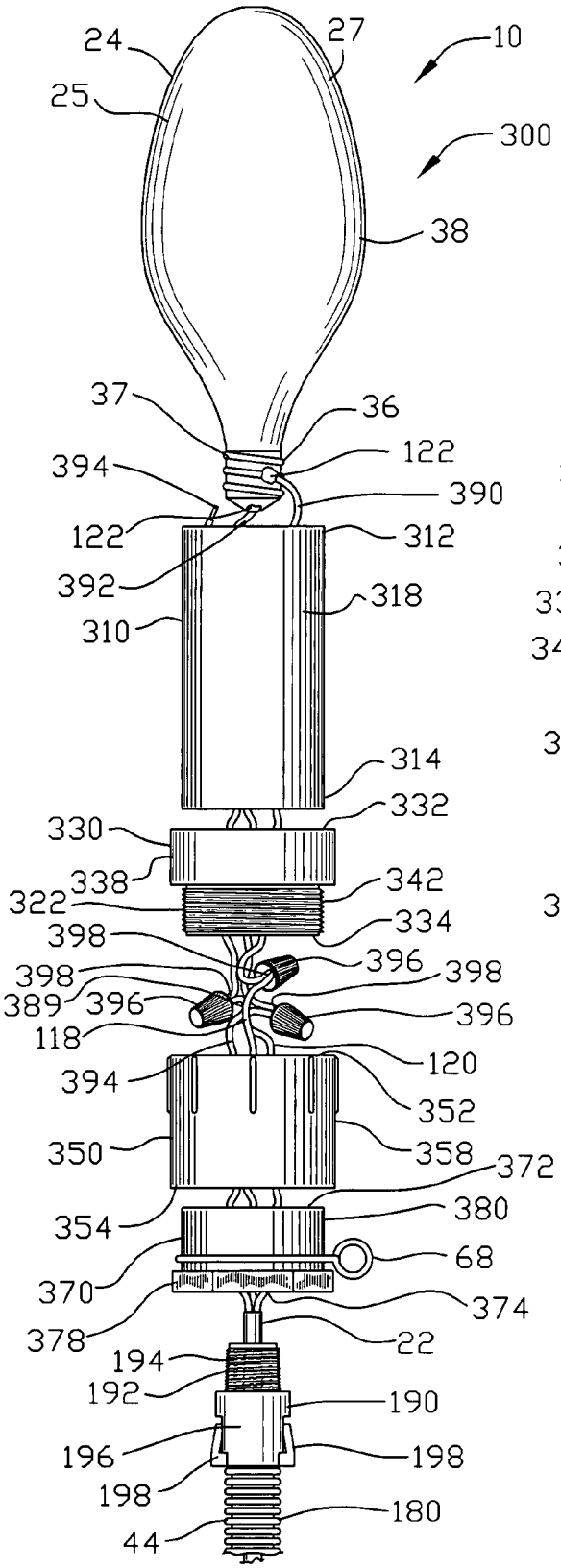
FIG. 27 is an exploded view of FIG. 25.

FIG. 24 illustrates the receptacle 150 being filled with the encasement 40 for encapsulates the cap 36 of the light bulb 24. The encasement 40 may comprises a curable polymeric material 42. The curable polymeric material 42 may include an electrical encapsulating and casting epoxy (EpoxySystems product #1700). Before filling the receptacle with curable polymeric material 42, a barrier 210 is placed over the cylinder aperture 159 to prevent the curable polymeric material 42 from exiting through the cylinder aperture 159. The barrier 210 may include tape, plate metal or an polymeric plate piece. The curable polymeric material 42 may be poured from a second dispenser 220 having a second dispenser nozzle 222. The nozzle 222 is inserted between the light bulb 24 and the receptacle aperture 176 for positioning over the receptacle 150. The curable polymeric material 42 while in a liquid form exits the second dispenser nozzle 222 and enters the receptacle 150. The curable polymeric material 42 is added until the curable polymeric material 42 fills the receptacle 150. The curable polymeric material 42 seals and encases the light bulb 24 into the receptacle 150. The cap 36 includes cap threads 37. The curable polymeric material 42 further seals and encases the cap threads 37 of the cap 36 to seal and encase the light bulb 24 to the encasement 40. Once the polymeric material 42 has cured the resulting encasement 40 has bonded the cap 36 and a portion of the body 38 of the light bulb 24 to the receptacle 150. This encasement 40 prevents any water intrusion into the encasement 40 to prevent corrosion of the cap 36 and electrical conductor 22.

FIGS. 25-30 illustrate a third embodiment 300 of the subject invention. The lighting system 10 is location beneath a surface 12 of a body of water 14 for illuminating the water 14 as shown in FIGS. 1 and 4-6. The lighting system 10 includes a light bulb 24 having a cap 36 and a body 38 having a positive buoyancy. An electrical conductor 22 electrically couples the cap 36 of the light bulb 24 to an electrical source 20 as best seen in FIGS. 1, 4-6 and 25-30. An elongated conduit 44 sheaths the electrical conductor 22. The electrical source 20 provides electrical current to the lighting system 10. The electrical source 20 may be 110 Volts, AC (alternating current). Electrical current travels through the electrical conductor 22 from the electrical source 20 to a light bulb 24. The light bulb 24 may include a 175 watt Philips mercury vapor bulb 25. Alternative, the light bulb 24 may include a halogen bulb 27. The electrical conductor 22 may include Colman cable (E54864-H SEOPRENE 105 16 AWG 3/C SEOOW (UL) 600V −50 TO 105c CSA LL39753-H FT2 WATER-RESISTANT((0.29/FT))).

The lighting system 10 includes a bulb housing 310 defining an interior chamber 316 that extends between a first aperture 312 and a second aperture 314. The bulb housing 310 may include a tube 318 constructed of metallic, polymeric or other rigid material. Preferably, the bulb housing 310 consists of a polymeric tube 318. The cap 36 is inserted into the first aperture 312 of the bulb housing 310 for positioning the cap 36 within the interior chamber 316 of the bulb housing 310. Preferably, the cap 36 is inserted into the first aperture 312 until the body 38 of the light bulb 24 is adjacent to the first aperture 312 of the bulb housing 310. A bead of sealant 320 may be applied between the body 38 of the light bulb 24 and the first aperture 312 of the bulb housing 310 for initially securing the light bulb 24 to the bulb housing 310. The sealant 320 may include 3-M 5200 sealant or other sealant materials.

An encasement 40 fills a portion of the interior chamber 316 of the bulb housing 310 for permanently securing the light bulb 24 to the bulb housing 310 and for encapsulating the cap 36 of the light bulb 24 within the interior chamber 316 of the bulb housing 310. The encasement 40 may comprises a curable polymeric material 42. The curable polymeric material 42 may include an electrical encapsulating and casting epoxy (EpoxySystems product #1700).

The second aperture 314 of the bulb housing 310 includes a male threading 342. The male threading 342 may comprise male threading integral with the bulb housing 310. Alternatively, the second aperture 314 may engage a bulb coupler 330 that defines an interior chamber 336 that extends between a first aperture 332 and a second aperture 334. The first aperture 332 of the bulb coupler 330 receives the second aperture 314 of the bulb housing 310. The second aperture 334 of the bulb coupler 330 has a male threading 342. The bulb coupler 330 may include a metallic, polymeric or other rigid material. Preferably, the bulb coupler 330 consists of a polymeric male adaptor 338 having both a coupling groove portion 340 and a male threading portion 342. The second aperture 314 of the bulb housing 310 is slidably inserted into the coupling groove portion 340 of the bulb coupler 330. The bulb housing 310 may be secured to the bulb coupler 330 by an adhesive 402. Preferably, the adhesive 402 may include a polymeric cement 403 that permanently secures the bulb housing 310 to the bulb coupler 330.

A base 370 secures the bulb housing 310 to the elongated conduit 44. The base 370 defines an interior chamber 376 extending between a first aperture 372 and a second aperture 374. The first aperture 372 of the base 370 includes a female threading 362. The female threading 362 may comprise female threading integral with the base 370. Alternatively, the base 370 may include a polymeric slip and thread bushing 378 wherein the first aperture 372 engages a base coupler 350. The base coupler 350 defines an interior chamber 356 that extends between a first aperture 352 and a second aperture 354. The second aperture 354 of the base coupler 350 receives the first aperture 372 of the base 370. The first aperture 352 of the base coupler 350 has a female threading 362. The base coupler 350 may include a metallic, polymeric or other rigid material. Preferably, the base coupler 350 is consists of a polymeric female adaptor 358 having both a coupling groove portion 360 and a female threading portion 362. The first aperture 372 of the base 370 is slidably inserted into the coupling groove portion 360 of the base coupler 350. The base 370 may be secured to the base coupler 350 by an adhesive 402. Preferably, the adhesive 402 may include a polymeric cement 403 that permanently secures the base 370 to the base coupler 350.

The second aperture 374 of the base 370 has a female threading 382 to facilitate the second aperture 374 of the base 370 engaging the elongated conduit 44. Preferably, the base 370 is secured to the elongated conduit 44 by a conduit coupler 190. The conduit coupler 190 may include nonmetallic coupling manufactured by Carlton Lamson. The conduit coupler 190 includes a male coupler head 192 for engaging the female threading 382 of the second aperture 374. The male coupler head 192 may include a threaded surface 194 for threadably engaging the female threading 382 for securing the bulb housing 310 to the conduit coupler 190. The conduit coupler 190 also includes a female coupler head 196 for engaging the elongated conduit 44. The female coupler head 196 includes a rib lock 198 for engaging and locking the conduit coupler 190 to the elongated conduit 44. The light bulb assembly including the bulb housing 310, bulb coupler 330, base coupler 350, base 370, conduit coupler 190 and elongated conduit 44 are preferably constructed from a non metallic material such as a polymeric material for resisting corrosion and ease of cleaning.

The interior chamber 316 of the bulb housing 310 from the encasement 40 to the second aperture 314 and the interior chamber 336 of the bulb coupler 330 form a first main chamber 384. The interior chamber 376 of the base 370 and the interior chamber 356 of the base coupler 350 form a second main chamber 386. The first and second main chambers 384 and 386 form an electrical coupler chamber 388 for housing an electrical junction 389 between the light bulb 24 and the electrical source 20. The electrical junction 389 electrically couples the electrical conductor 22 to the cap 36 of the light bulb 24. The electrical junction 389 facilitates the removal of the light bulb 24 from the elongated conduit 44. The electrical junction 389 also provides empty volume of air to provide buoyancy of the light bulb 24. Buoyancy is required where the light system 10 is utilized in turbulent water conditions and/or the light bulb 24 does not provide any buoyancy.

The threading engagement between the polymeric male adaptor 338 and the polymeric female adaptor 358 permits the light bulb 24 and bulb housing 310 assembly to be removable from the elongated conduit 44. Preferably, the polymeric male adaptor 338 and the polymeric female adaptor 358 are torqued to 20 ft lbs. by use with tools such as channel locks or a pipe wrench. After separation of the polymeric male adaptor 338 from the polymeric female adaptor 358, the electrical junction 389 is exposed to permit separation of the electrical junction 389 to separate the light bulb 24 from the elongated conduit 44.

A pipe thread compound 322 may be applied to the both the male threading 342 of the polymeric male adaptor 338 and the female threading 362 of the polymeric female adaptor 358 for preventing water from traveling between the male threading 342 and female threading 362 and entering the electrical junction 389. The pipe thread compound 322 temporary seals the male threading 342 of the polymeric male adaptor 338 and the female threading 362 of the polymeric female adaptor 358 for facilitating the removal of the light bulb 24 from the elongated conduit 44. The pipe thread compound 322 may include Dow Corning M-55 grease.

The sealing between the bulb housing 310 and the encasement 40, the bulb housing 310 and the bulb coupler 330, the male threading 342 and the female threading 362, the base coupler 350 and the base 370, the base 370 and the conduit coupler 190 may be tested by coupling the conduit coupler 190 to a pressurizing source. The pressurizing source inputs a pressurized volume into the electrical junction 389 to test all of the joints for leakage.

A tamper evident seal 410 having an adhesive layer may be secured between the polymeric male adaptor 338 and the polymeric female adaptor 358. The tamper evident seal 410 deforms and/or breaks upon rotation of the polymeric male adaptor 338 relative to the polymeric female adaptor 358. Any deformation and/or breaking of the tamper evident seal 410 would serve to indicate separation of the polymeric male adaptor 338 from to the polymeric female adaptor 358 and may further indicate intrusion of moisture within the electrical junction 389.

The electrical conductor 22 further includes a first bulb wire 390, a second wire 392 and a ground wire 394. The first bulb wire 390 extends from the cap threads 37 of the cap 36 to the electrical junction 389. The second bulb wire 392 extends from the cap 36 to the electrical junction 389. The ground wire 394 extends from the encasement 40 to the electrical junction 389. Each of first, second and ground wires 390, 392 and 394 are coupled to the respective electrical conductor lead 22 within the electrical junction 389. A wire coupler 396 joints each of the first, second and ground wires 390, 392 and 394 with their respective electrical conductor lead 22. A wire coupler sealant 394 may be injected into the wire couplers 396 to further prevent moisture from contacting the first, second and ground wires 390, 392, 394 and/or electrical conductor 22.

Figure 28:
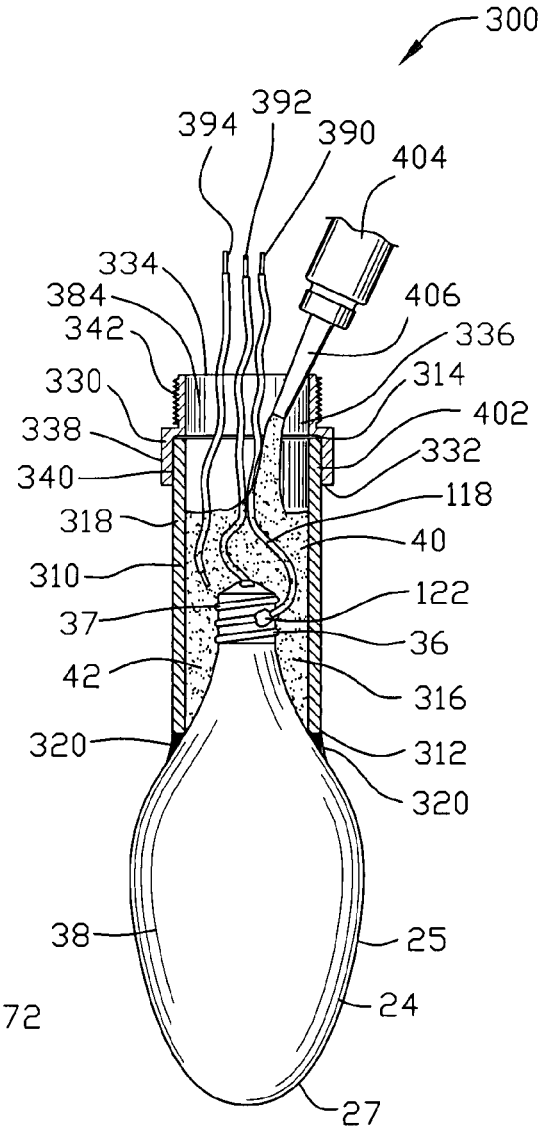
FIG. 28 is an inverted view of a portion of FIG. 2 illustrating a sealant poured into an upper housing.
Figure 29:
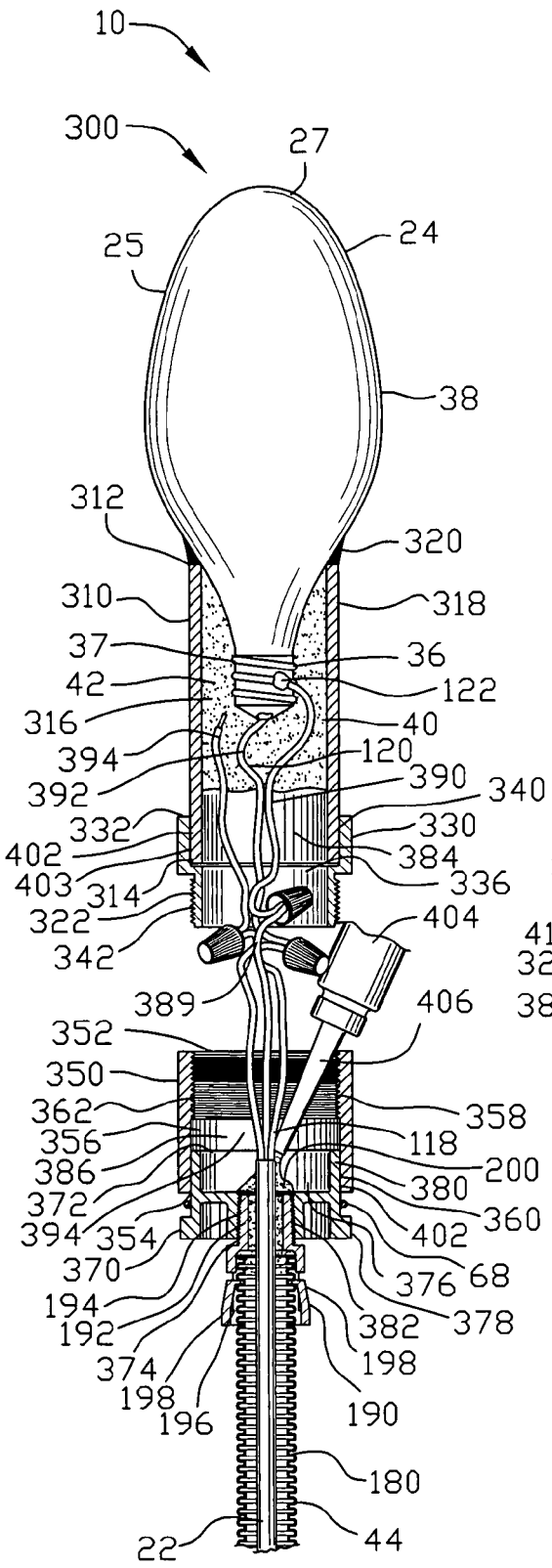
FIG. 29 is a view similar to FIG. 26 illustrating a sealant poured into a lower housing.
Figure 30:
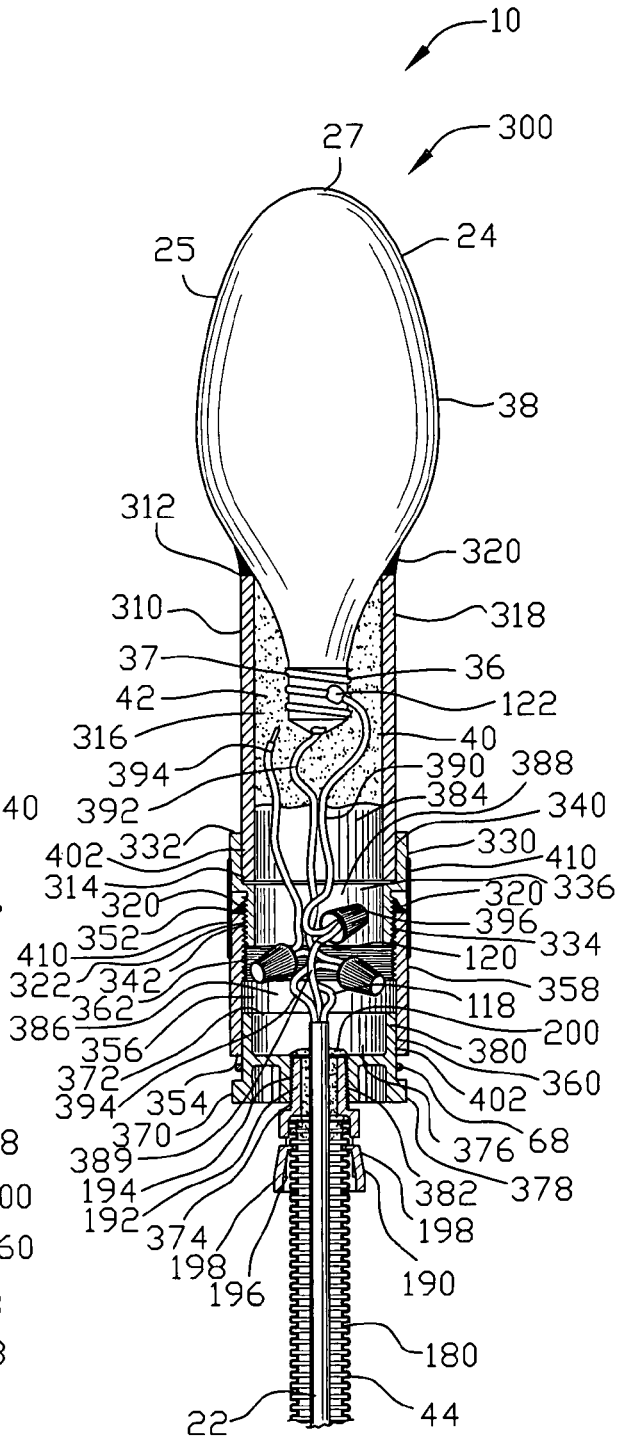
FIG. 30 is a view similar to FIG. 26 illustrating a sealant and a tamper covering positioned to the lighting system.

As best seen in FIGS. 28-30, subject invention for the third embodiment 300 also incorporates the process of manufacturing a lighting system 10 for removably securing a light bulb 24 to an elongated conduit 44. The first and second wires 390 and 392 are soldered to the cap 36 of the light bulb 24. The cap 36 is inserted into the first aperture 312 of the bulb housing 310 for positioning the cap 36 within the interior chamber 316 of the bulb housing 310. The cap 36 is inserted into the first aperture 312 until the body 38 of the light bulb 24 is adjacent to the first aperture 312 of the bulb housing 310. A bead of sealant 320 is applied between the body 38 of the light bulb 24 and the first aperture 312 of the bulb housing 310 for initially securing the light bulb 24 to the bulb housing 310. The sealant 320 may include 3-M 5200 sealant or other sealant materials.

After the sealant 320 has cured, the light bulb 24 and bulb housing 310 assembly is positioned such that the bulb housing 310 is above the light bulb 24. The ground wire 394 is positioned within the bulb housing 310 such that one of the terminal ends is approximate to the cap 36. The curable polymeric material 42 is then poured through the second aperture 314 and into the interior chamber 316 until the cap 36 and terminal end of the ground wire 394 are covered by the curable polymeric material 42. The curable polymeric material 42 may include an electrical encapsulating and casting epoxy (EpoxySystems product #1700). The curable polymeric material 42 may be poured from a dispenser 404 having a dispenser nozzle 406. Once the polymeric material 42 is cured, an encasement 40 is formed that fills a portion of the interior chamber 316 of the bulb housing 310 that permanently securing the light bulb 24 to the bulb housing 310 and for encapsulating the cap 36 of the light bulb 24 within the interior chamber 316 of the bulb housing 310. The cured polymeric material 42 further prevents moisture from corrosion of the cap 36 or the first, second and ground wires 390, 392 and 394 ends.

The polymeric cement 403 is applied to the groove 340 of the bulb coupler 330 and then the second aperture 314 of the bulb housing 310 is inserted into the groove 340 of the polymeric male adaptor 338. The first, second and ground wires 390, 392 and 394 are positioned within the first main chamber 384.

The female coupler head 196 of the conduit coupler 190 is positioned over the elongated conduit 44 to permit the rib locks 198 to engage the plurality of ribs 180 of the elongated conduit 44. The male coupler head 192 of the conduit coupler 190 is then threadably engaged into the second aperture 374 of the base 370. The electrical conductor 22 is feed through the elongated conduit 44 and through both the conduit coupler 190 and the base 370.

The curable polymeric material 42 is then poured through the first aperture 372 of the base 370 and into the interior chamber 376 until the conduit coupler 190 and the second aperture 374 are covered by the curable polymeric material 42. The curable polymeric material 42 may include an electrical encapsulating and casting epoxy (EpoxySystems product #1700). The curable polymeric material 42 may be poured from a dispenser 404 having a dispenser nozzle 406. Once the polymeric material 42 is cured, a second encasement 408 is formed that fills a portion of the interior chamber 376 of the base 370 that permanently secures the electrical conductor 22 relative the base 370. The cured polymeric material 42 further prevents moisture from traversing from the elongated conduit 44 to the interior chamber 376 of the base 370.

The polymeric cement 403 is applied to the groove 360 of the base coupler 350 and then the first aperture 372 of the base 370 is inserted into the groove 360 of the polymeric female adaptor 358. The leads to the electrical conductor 22 are positioned within the second main chamber 386.

The first, second and ground wires 390, 392 and 394 are twisted together with their corresponding leads of the electrical conductor 22 to form the electrical junction 389 between the light bulb 24 and the electrical source 20. A wire coupler 396 is positioned over each of the twisted electrical unions. Wire coupler sealant 398 may be injected to the wire couplers 396 to prevent moisture from corroding the first, second and ground wires 390, 392 and 394 ends. The length of the first, second and ground wires 390, 392 and 394 and the length of the electrical conductor 22 that is located within the electrical coupler chamber should be of a length to permit multiple rotations of the first, second and ground wires 390, 392 and 394 and the electrical conductor 22 during rotational engaging between the bulb housing 310 and the base 370 without permanently deforming the first, second and ground wires 390, 392 and 394 and the electrical conductor 22.

The pipe thread compound 322 may be applied to the both the male threading 342 of the polymeric male adaptor 338 and the female threading 362 of the polymeric female adaptor 358 prior to rotational engaging the polymeric male adaptor 338 with the polymeric female adaptor 358. The pipe thread compound 322 prevents water from traveling between the male threading 342 and female threading 362 and entering the electrical junction 389. The pipe thread compound 322 temporary seals the male threading 342 of the polymeric male adaptor 338 and the female threading 362 of the polymeric female adaptor 358. for facilitating the removal of the light bulb 24 from the elongated conduit 44.

The male threading 342 of the polymeric male adaptor 338 is then rotationally engaged with the female threading 362 of the polymeric female adaptor 358 for creating the electrical junction 389 that houses the electrical junction 389. The male threading 342 of the polymeric male adaptor 338 and the female threading 362 of the polymeric female adaptor 358 permits the light bulb 24 to be physically removed from the elongated conduit 44. The electrical junction 389 permits the light bulb 24 to be electrically removed from the electrical conductor 22. If the light bulb 24 requires replacing the threading engagement between the polymeric male adaptor 338 and the polymeric female adaptor 358 and the electrical junction 389 permits removal of the damaged light bulb 24 and the installation of the new light bulb 24 without having to replacing the entire lighting system 10.

A bead of sealant 324 may be applied on the mating joint between the male threading 342 of the polymeric male adaptor 338 and the female threading 362 of the polymeric female adaptor 358 for further preventing water from traveling between the male threading 342 and female threading 362 and entering the electrical junction 389. A tamper evident seal 410 having an adhesive layer may be applied between the polymeric male adaptor 338 and the polymeric female adaptor 358. The tamper evident seal 410 deforms and/or breaks upon rotation of the polymeric male adaptor 338 relative to the polymeric female adaptor 358. Any deformation and/or breaking of the tamper evident seal 410 would serve to indicate separation of the polymeric male adaptor 338 from to the polymeric female adaptor 358 and may further indicate intrusion of moisture within the electrical junction 389.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A lighting system for location beneath a surface of a body of water for illuminating the water, comprising:

a light bulb having a cap and a body having a positive buoyancy;

an electrical conductor electrically coupling said cap of said light bulb to an electrical source;

an encasement for encapsulating said cap of said light bulb;

an elongated conduit for sheathing said electrical conductor;

an anchor engaging said elongated conduit for submerging said light bulb beneath the surface of the water;

said anchor further comprises a mass;

said mass including a sleeve for slidably engaging said elongated conduit;

said encasement including a bulb clip;

said mass including a mass clip; and a lanyard extending from said bulb clip through said mass clip to the surface of the water for simultaneously sliding said elongated conduit relative to said sleeve and adjusting the depth of said bulb with the body of water.

2. A lighting system for location beneath a surface of a body of water for illuminating the water, comprising:

a light bulb having a cap and a body having a positive buoyancy;

an electrical conductor electrically coupling said cap of said light bulb to an electrical source;

an elongated conduit for sheathing said electrical conductor;

a bulb housing defining an interior chamber extending between a first aperture and a second aperture;

an encasement filling a portion of said interior chamber of said bulb housing for securing said light bulb to said bulb housing and encapsulating said cap of said light bulb within said interior chamber of said bulb housing;

a bulb coupler defining an interior chamber extending between a first aperture and a second aperture;

said first aperture of said bulb coupler receiving said second aperture of said bulb housing;

said second aperture of said bulb coupler having a male threading;

a base defining an interior chamber extending between a first aperture and a second aperture;

said second aperture of said base defining a female threading for threadably engaging said elongated conduit;

a base coupler defining an interior chamber extending between a first aperture and a second aperture;

said second aperture of said base coupler for receiving said first aperture of said base;

said first aperture of said base coupler having a female threading; and said male threading of said bulb coupler threadably engaging said female threading of said base coupler for removably securing said light bulb to said elongated conduit.

3. A lighting system for location beneath a surface of a body of water for illuminating the water, comprising:

a light bulb having a cap and a body having a positive buoyancy;

an electrical conductor electrically coupling said cap of said light bulb to an electrical source;

an elongated conduit for sheathing said electrical conductor;

a bulb housing defining an interior chamber extending between a first aperture and a second aperture;

an encasement filling a portion of said interior chamber of said bulb housing for securing said light bulb to said bulb housing and encapsulating said ca of said light bulb within said interior chamber of said bulb housing;

a bulb coupler defining an interior chamber extending between a first aperture and a second aperture;

said first aperture of said bulb coupler receiving said second aperture of said bulb housing;

said second aperture of said bulb coupler having a male threading;

a base defining an interior chamber extending between a first aperture and a second aperture;

said second aperture of said base defining a female threading for threadably engaging said elongated conduit;

a base coupler defining an interior chamber extending between a first aperture and a second aperture;

said second aperture of said base coupler for receiving said first aperture of said base;

said first aperture of said base coupler having a female threading;

said male threading of said bulb coupler threadably engaging said female threading of said base coupler for removably securing said light bulb to said elongated conduit; and a pipe thread compound temporary sealing said male threading of said bulb coupler with said female threading of said base coupler for facilitating the removal of said light bulb from said elongated conduit.

* * * * *